US008631596B2

(12) United States Patent
Tulibaski

(10) Patent No.: US 8,631,596 B2
(45) Date of Patent: Jan. 21, 2014

(54) MATERIAL-HANDLING BUCKET WITH SCRAPER BLADE

(76) Inventor: Ben Tulibaski, Pennock, MN (US)

( * ) Notice: Subject to any disclaimer, the term of this patent is extended or adjusted under 35 U.S.C. 154(b) by 314 days.

(21) Appl. No.: 13/010,025

(22) Filed: Jan. 20, 2011

(65) Prior Publication Data

US 2012/0186112 A1 Jul. 26, 2012

(51) Int. Cl.
*E02F 3/40* (2006.01)

(52) U.S. Cl.
USPC ..... 37/444; 172/817; 414/726

(58) Field of Classification Search
USPC ..... 37/403–410, 417, 431, 433, 439, 416, 37/444, 424–428, 442, 445, 443, 411; 172/815, 817; 414/722–725, 726; 294/51, 54.5, 55, 63.26
See application file for complete search history.

(56) References Cited

U.S. PATENT DOCUMENTS

| | | | | |
|---|---|---|---|---|
| 2,530,414 | A | 11/1950 | Wells | |
| 2,558,531 | A | 6/1951 | Bain | |
| 2,812,595 | A | 11/1957 | Drott | |
| 2,840,932 | A | 7/1958 | Breyer | |
| 3,039,210 | A | 6/1962 | Slaughter | |
| 3,077,999 | A | 2/1963 | Svoboda | |
| 3,209,474 | A | 10/1965 | Artman | |
| 3,209,475 | A | 10/1965 | Salna | |
| 3,238,648 | A | 3/1966 | Cobb et al. | |
| 3,897,641 | A | 8/1975 | Moser | |
| 4,081,919 | A | 4/1978 | Teach | |
| 5,273,375 | A | 12/1993 | Plourde | |
| 5,416,990 | A | 5/1995 | Otwell | |
| 5,526,591 | A * | 6/1996 | Otwell | 37/444 |
| 5,555,944 | A | 9/1996 | Kimoto | |
| 5,806,607 | A | 9/1998 | Sanders | |
| 5,833,008 | A | 11/1998 | Reed et al. | |
| 6,067,733 | A | 5/2000 | Gasper | |
| 6,434,863 | B1 | 8/2002 | Meurer | |
| 6,662,480 | B1 | 12/2003 | Stevens | |
| 6,701,630 | B2 | 3/2004 | Humphrey | |
| 6,913,086 | B2 | 7/2005 | Stevens | |
| 6,928,758 | B1 | 8/2005 | Stout | |
| 7,454,850 | B2 * | 11/2008 | Smith | 37/417 |
| 7,506,462 | B2 | 3/2009 | Reid | |
| 7,562,473 | B2 | 7/2009 | Westendorf et al. | |
| 935,288 | A1 | 9/2009 | Witter | |
| 7,631,446 | B1 | 12/2009 | Davis | |
| 2008/0313934 | A1 | 12/2008 | Smoljo | |

OTHER PUBLICATIONS

Ashland Industries, "Ashland Scrapers", http://www.ashlandind.com/EARTHMOVERS.HTML, dated Jul. 21, 2010, 3 pgs.

(Continued)

*Primary Examiner* — Robert Pezzuto
(74) *Attorney, Agent, or Firm* — Merchant & Gould P.C.

(57) ABSTRACT

An improved material handling bucket assembly is configured for construction or agricultural front loading or backhoe applications. Scraper and grader blades pivotally mounted relative to the bucket bottom cooperatively move to provide normal bucket operation, or scraping, or grading operations. A scraper blade selectively rotates between a first position closing an opening through the bottom wall of the bucket to a second position extending below the bucket for removing ground soil during a scraping operation and directing the removed soil into a collection chamber of the bucket. A single power source and linkage assembly controls movement of the scraper and grader blades, which also cooperatively move to change the size of the opening in the bottom wall during a scraping operation.

30 Claims, 20 Drawing Sheets

(56) References Cited

OTHER PUBLICATIONS

Ashland Industries, "Ashland Earthmovers, Ground Hog 2500" brochure; 2007, 2 pgs.

Bobcat Company, "Box Scraper Attachment", http://www.bobcat.com/attachments/box_scraper, dated Jul. 21, 2010, 3 pgs.

* cited by examiner

MATERIAL-HANDLING BUCKET WITH SCRAPER BLADE

FIELD OF THE INVENTION

This invention relates generally to the field of construction or earth working equipment, and more specifically to an improved material handling bucket for use with such equipment as, for example, skid loaders, backhoes, pay loaders, farm tractors and other types of earth working construction or agricultural equipment in which a bucket is moved and/or manipulated by the equipment to perform grading, scraping, digging, or the like.

BACKGROUND OF THE INVENTION

The present invention applies to any type of earth working or material handling bucket of the type attached to and carried, moved and manipulated by a motive power source such as a vehicular piece of construction or agricultural equipment, in contrast to wheeled earth scraper apparatus that are pulled or pushed in trailer fashion over the earth surface being worked. Such construction or agricultural equipment includes, but is not limited to loaders of the skid steered type as well as those having continuous tracks instead of wheels, to mini-payloaders and larger loader equipment, to farm equipment such as tractors, power shovels and backhoe equipment and other such types of earth and material working and handling equipment. The buckets used with such equipment vary in configuration but typically comprise an open top construction having a primary forward blade at one edge of the bucket that defines an open chamber for retainably holding and carrying the earth or material manipulated into the bucket. Those buckets mounted to the equipment for use primarily by pushing the bucket in a forward direction (commonly referred to as front-end loaders) typically have a triangular cross-section shape with a relatively flat bottom surface, two side walls and a back wall; whereas those buckets used by backhoe equipment and functionally mounted to dig and handle material by being pulled toward the equipment, can also be configured with an open front bucket configuration but can also define more rectangular four-sided material handling chambers with a primary blade portion being configured on that upper edge of the sidewall located closest to the supporting equipment. The principles of this invention apply equally well to both types of the above-described bucket configurations.

The buckets to which this invention applies are very versatile and are used to perform a great variety of earth and material moving and handling features, including for example scooping, loading and transporting material, back dragging a material surface, cutting into material banks, leveling, landscraping, grading, skid shoveling, backhoeing, excavating, scraping and the like. The above-described buckets are generally designed primarily for handling and moving or transporting large amounts of bulk material. However, the buckets are often used for many of the above-described tasks for which they are not optimally designed. For example, such buckets are not typically optimally designed for scraping or skimming, grading, or scarifying surface material. As used herein, the terms scraping and skimming will be used interchangeably to describe an operation wherein a "cut" of material of predetermined depth is removed from a surface over which the bucket is moved. With conventional bucket designs, when the primary blade of the bucket is used for scraping operations, the blade tends to dig into the material surface when the blade is advanced in a forward direction of the bucket, providing uneven material removal. Similarly, to perform grading or leveling operations with such buckets, the bottom of the bucket is typically placed on the ground surface and the bucket is dragged "backward" to pull earth and material behind the bucket. Typical buckets do not allow for significant material to be accumulated behind the bucket when used in this manner, and the rear surfaces of conventional buckets are not designed and reinforced for extended use in this manner. Alternatively, the bucket may be raised and tipped forward such that the bottom of the bucket is generally vertical to the ground surface and then lowered until the front blade engages the ground. The bucket is then dragged backwards to pull earth and soil behind the bucket for grading the material surface. Such operation places significant torque on the bucket and excessive wear and tear on the hydraulic cylinders and linkage that control the bucket rotation. Such inadequacies of conventional buckets have been recognized in the field, and a number of bucket design configurations have been proposed to address the above issues.

For example, designs have focused on configuring articulated buckets having pivotal clam-like cooperative portions that selectively open and close along their lateral widths, such as shown, for example, in U.S. Pat. No. 3,209,474. Such designs are fairly cumbersome and relatively expensive to implement, and do not optimally provide for simultaneous uniform scraping removal and retention of soil or material from a surface.

Other designs, such as shown in U.S. Pat. No. 3,209,475 provide a bucket having forward and rearward mounted scraper blades. The forward blade forms a front surface of and closes the front opening of the bucket such that it is not usable as a conventional front-end loader bucket. The bucket is articulated with respect to the rear blade and can be height adjusted relative to the rear blade to capture material scraped by the rear blade into the back of the bucket. Such design requires skilled operator coordination of the relative positions of the first and second blades and does not enable the bucket to be used for multipurpose loading and transporting functions through front-end loading thereof.

Other scraper designs, such as shown in U.S. Pat. No. 5,806,607 are configured as add-on special use devices for conventional bulldozer blades, or as special purpose skimming bucket configurations that do not provide for closure of the opening adjacent the rearward skimming blade when the bucket is used for loading or material carrying functions.

The above described devices are intended only to be representative configurations that are found in the art, and serve to exemplify the deficiencies of such designs for providing effective, simple, reliable and user-friendly multipurpose bucket configurations that can alternatively be used on-the-fly as a conventional front loading bucket and/or as a scraper that employs the same front loading bucket to collect the scraper removed material. The present invention addresses these and other shortcomings of such prior art bucket designs.

In certain excavation operations, such as in forming trenches for laying cylindrical pipelines, it is desirable and sometimes required that the bottom of the trench have a rounded or hemispherical cross-sectional shape that matches that of the pipe to be supported by the trench. A number of bucket configurations having specialized add-on or integral apparatus for forming the desired specialized cross-sectional trench shape are known in the art. Such designs, however, are generally cumbersome, often require work to be delayed while the special attachment is applied to the bucket, and generally do not provide the flexibility of use of the bucket for its primary intended excavation process when such trench shaping process is not needed or desired. The present invention also addresses the shortcomings of such prior art trenching bucket designs.

SUMMARY OF THE INVENTION

The present invention provides a simple, efficient, cost-effective and reliable material handling bucket assembly usable with construction or agricultural earth moving and handling motive power equipment. The bucket assembly can include both scraper and grader blades cooperatively movable and operable to allow the bucket to be used in a traditional manner, or to be rapidly converted to scraper or grading applications. Scraper and grader blades are rotatably mounted to the bucket adjacent an enlarged opening formed through the bottom wall of the bucket. When the bucket assembly is used in a traditional conventional manner, the scraper and grader blades cooperatively close or substantially close the opening through the bottom wall of the bucket. By simple rotation of the scraper blade relative to the bottom wall opening, the bucket can rapidly be transitioned for use as a scraper, wherein the scraper blade engages and removes ground soil from a ground surface and directs such removed soil into a collection chamber of the bucket through the opening in the bottom wall. The grader blade or alternative panel type member rotatably position adjacent the enlarged opening enables the effective opening area to be enlarged in response to the volume of removed material being directed toward the opening. The scraper blade concept also applies to excavation bucket designs for selective removal of material from trenches for forming, for example, bottom trench configurations of varied geometrical cross-sections.

According to one aspect of the invention there is provided a material handling bucket assembly configured to mount to a motive power source and suitable for removal of ground soil in response to movement of the bucket assembly over or into the ground. The material handling bucket comprises a bottom wall having a front edge, sidewalls and a rear wall arranged and configured to define a collection chamber for collecting ground soil engaged and removed from the ground by the front edge. The rear wall of the bucket is fixedly connected to the bottom and sidewalls and is operatively disposed and spaced from the front edge. The bottom wall defines a soil receiving opening therethrough, disposed between the front edge of the bucket and the rear wall, which opening is always present in the bottom wall. A scraper blade is pivotally movable between a first position disposed to substantially close the opening in the bottom wall, and a second position extending from the bottom wall opening outside of the collection chamber, in a manner so as to engage, remove and direct ground soil underlying the bottom wall through the opening and into the collection chamber when the bottom wall of the bucket assembly is caused to be moved along the ground surface in a direction toward the front edge, which the front edge sliding over the ground surface. In this manner, ground soil is removed by the scraper blade and deposited within the collection chamber through the bottom opening.

A power source is mounted to the bucket assembly and operatively connected with the scraper blade to move the scraper blade between first and second positions. According to one aspect of the invention, the power source comprises a hydraulic cylinder and linkage assembly connecting the hydraulic cylinder with the scraper blade. The scraper blade has a maximum range of travel position corresponding to a maximum cut depth into the ground surface, and the power source is operable to move the scraper blade through an infinite number of possible scrape depth positions between the blade's first closed position and the maximum range of travel position.

According to one aspect of the invention, the hydraulic cylinder is mounted to the rear wall of the bucket and a portion of the linkage assembly connects to the scraper blade through the rear wall.

According to yet another aspect of the invention, a second blade or panel member is also mounted for rotational motion adjacent the opening in the bottom wall and cooperates with the scraper blade to regulate the cross-sectional area or size of the opening during a scraping operation. A panel member pivots upwardly into the bucket collection chamber in response to the degree of force or pressure applied to the panel member by the removed ground soil during a scraping operation.

According to one aspect of the invention, a second pivotable panel or blade member comprises a grader blade that is also pivotable through the bottom wall opening, in a downward direction to function as a grading blade for grading operations.

According a further aspect of the invention, the scraper blade and associated linkage and power assemblies cooperatively move the grader blade into an operative grading position using a unique camming apparatus and operation.

According to yet a further aspect of the invention, a front wall member designed for pivotal connection to the bucket assembly rotates downward to close the front end of the bucket assembly for increasing the collection chamber volume during a scraping operation.

According to yet a further aspect of the invention there is provided a method of scraping ground soil from a ground surface into a soil collection chamber of a bucket assembly of a type having a bottom wall with a front edge and an opening spaced back from the front edge and formed through the bottom wall, a pair of sidewalls, and a rear wall collectively defining the soil collection chamber, comprising: lower the bucket assembly to engage the bottom wall with a ground surface; lowering a scraper blade adjacent said opening in the bottom wall by rotating a forward edge of the scraper blade to a position below the bottom wall through the ground surface and into engagement with said soil; advancing the bucket assembly in the direction of the front edge, causing the scraper blade to dislodge the engaged soil; and directing the dislodged soil along the scraper blade and through the opening into the collection chamber.

According to yet a further aspect of the invention, the method may include pivoting a panel member adjacent the opening, upwardly from the bottom wall during the advancing step to variably change the effective area of the opening in response to the volume of the dislodged soil being directed toward the opening.

According to yet a further aspect of the invention there is provided a kit for retrofitting a material handling bucket for bottom scraping operations, wherein the bucket is of the type having a bottom wall with a front edge, a pair of opposed sidewalls connected to the bottom wall along their lower edges, and a rear wall connected to the bottom and sidewalls and disposed opposite the forward edge. The combination of recited walls collectively cooperatively define a collection chamber for holding material such as ground soil. According to one aspect of the invention, the kit comprises a template and instructions for removing a portion of the bottom wall to form an elongate opening therethrough; a scraper blade sized and configured to operatively cooperate with the formed opening; a first one or more hinges configured to pivotally attach the scraper blade to the bottom wall and to position the scraper blade for cooperative pivotal movement relative to the elongate opening, such that the scraper blade is pivotally movable between a first position at least partially closing the elongate opening and a second position wherein its distal blade edge extends below the bottom wall and the opening and projects at an acute angle with the bottom wall in a direction toward the front edge; at least hydraulic cylinder mounting bracket configured for attachment to the rear wall; and a linkage assembly configured for attachment to the cylinder mounting bracket and movable to transmit forces from a hydraulic cylinder operatively mounted to the bracket, to pivotally move the scraper blade. According to yet a further aspect of the invention, the kit may include a panel member sized and configured to cooperatively engage the scraper blade adjacent the elongate opening and a second one or more hinge configured to pivotally attach the panel member to the bottom wall for pivotal movement between a first position at least partially covering the elongate opening to a second position wherein its distal unsecured end pivots upwardly away from the bottom wall, selectively uncovering the elongate opening.

According to yet another aspect of the invention, the rotatable scraper blade may be configured for use in association with a backhoe type of bucket to scrape material from a bottom surface of a trench, or to form a trench, particularly those with unique cross-sectional geometrical shapes.

These and other alternative configurations and features and advantages of the present invention will be recognized by those skilled in the art in view of the following description of preferred embodiments of the invention. The description of such preferred embodiments of the invention are presented to acquaint the reader with the unique and novel features and principles of the invention and are not intended to be construed so as to limit the scope of the invention.

BRIEF DESCRIPTION OF THE DRAWINGS

Referring to the drawings, wherein like numerals represent like parts throughout the several views.

DETAILED DESCRIPTION OF THE PREFERRED EMBODIMENTS OF THE INVENTION

The below described preferred embodiments of bucket assemblies illustrate the general principles embodied in the invention. Such descriptions are not intended to be offered or used in any limiting manners, but only illustrate specific examples of bucket assemblies and portions thereof incorporating the broad principles of the invention. All alternatives and variations of the principles and features of the described embodiments are intended to be included within the broad scope of the claims appended hereto, whether such variations and alternatives are specifically addressed herein.

Figure 10:
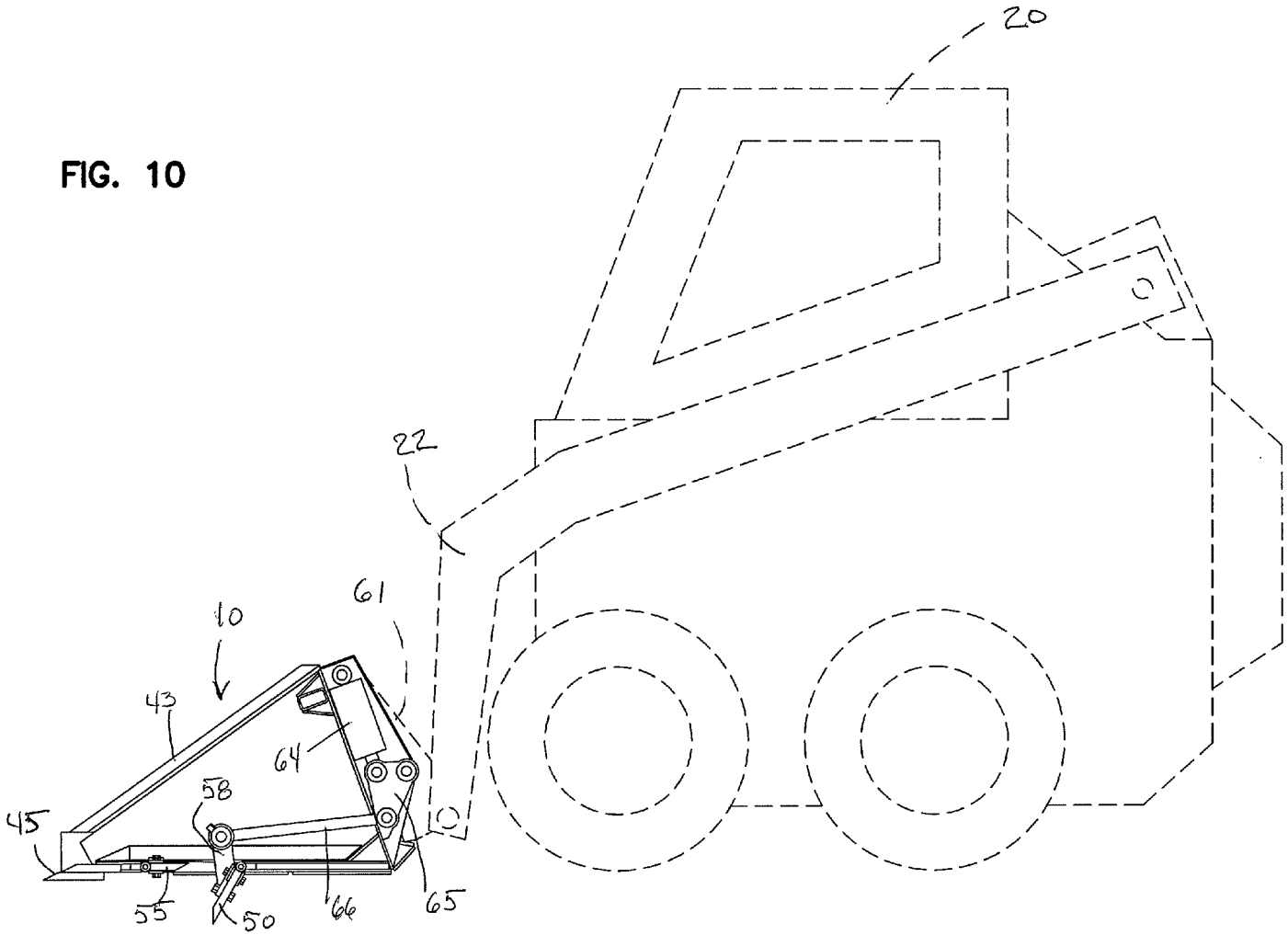
FIG. 10 is an illustration on the bucket assembly of FIG. 9 illustrated as operatively connected by way of the Universal connection to a motive power source such as a skid steerer.

Referring to the Figures, a first embodiment of a bucket assembly incorporating the principles of this invention is illustrated at 10. As used herein in describing the bucket assemblies of the preferred embodiments, the terms "bucket assembly" and "bucket" will be used interchangeably. The bucket assembly 10 of the first embodiment is generally of the type referred to as a front-end loading bucket, since when connected to a motive power source 20 as illustrated in FIG. 10, the bucket assembly is generally filled with material during a bucket loading operation by movement of the motive power source in a forward direction.

As discussed in the Background of the Invention section, the invention is not limited to use with any particular motive power source. While the particular motive power source 20 illustrated in the Figures and described with respect to the bucket assembly is a skid steerer, it will be understood by those skilled in the art that the invention applies to any type of construction or agricultural equipment that is capable of controlling and manipulating the bucket assembly. By way of example only, such construction and agricultural equipment includes but is not limited to loaders of the skid steered type as well as to those having continuous tracks instead of wheels, to mini-payloaders and larger loader equipment, to farm equipment such as tractors, power shovels and backhoe equipment and other such types of earth and material working and handling equipment.

Referring to the Figures, a preferred embodiment construction of a bucket assembly 10 is illustrated. The bucket assembly illustrated in FIGS. 1-15 is of a type particularly suited for use with a skid steerer motive power source and has an open front and top configuration. The bucket assembly 10 includes a generally vertically oriented rear wall 30 having its bottom edge secured to a bottom wall generally indicated at 32, and its opposed lateral ends connected to right and left sidewalls 34 and 35 respectively, as viewed from the front of the bucket assembly. The rear wall 30 defines a pair of generally rectangular openings 30*a* formed therethrough (FIGS. 1 and 3) for enabling passage of linkage rod members (hereinafter described) therethrough.

The sidewalls 34, 35 are generally triangular in shape, having their lower edges thereof connected to the bottom wall 32 and their rearward edges connected to the lateral ends of the rear wall 30. In the construction of the preferred embodiment, the connections between the rear, bottom and right and left sidewalls are formed by welding wall members to one another to form the open bucket shape illustrated in the Figures. As assembled, the walls define a containment collection chamber 15 for holding bulk materials such as ground soil or other materials to be handled and/or moved or transported by the bucket assembly, as is well known in the art. A rear gusset bar 36, generally triangular in cross-section is welded to and forms a strengthening member between the rear wall 30 and the bottom wall 32. Right and left gusset members 37 and 38 respectively, also generally triangular in cross-section in the preferred embodiment illustrated, are welded to the right and left sidewalls 34 and 35 respectively and to the bottom wall 32 (FIG. 3) to provide strengthening support between the sidewalls and the bottom wall along the bottom portions of the sidewalls. An upper support gusset bar 39, having a generally triangular outer shape is welded to and along the upper edge of the rear wall 30 and has its opposite laterally disposed ends welded to the inwardly facing surfaces of the right and left sidewalls 34, 35, providing structural support for the upper portion of the bucket assembly.

Figure 20:
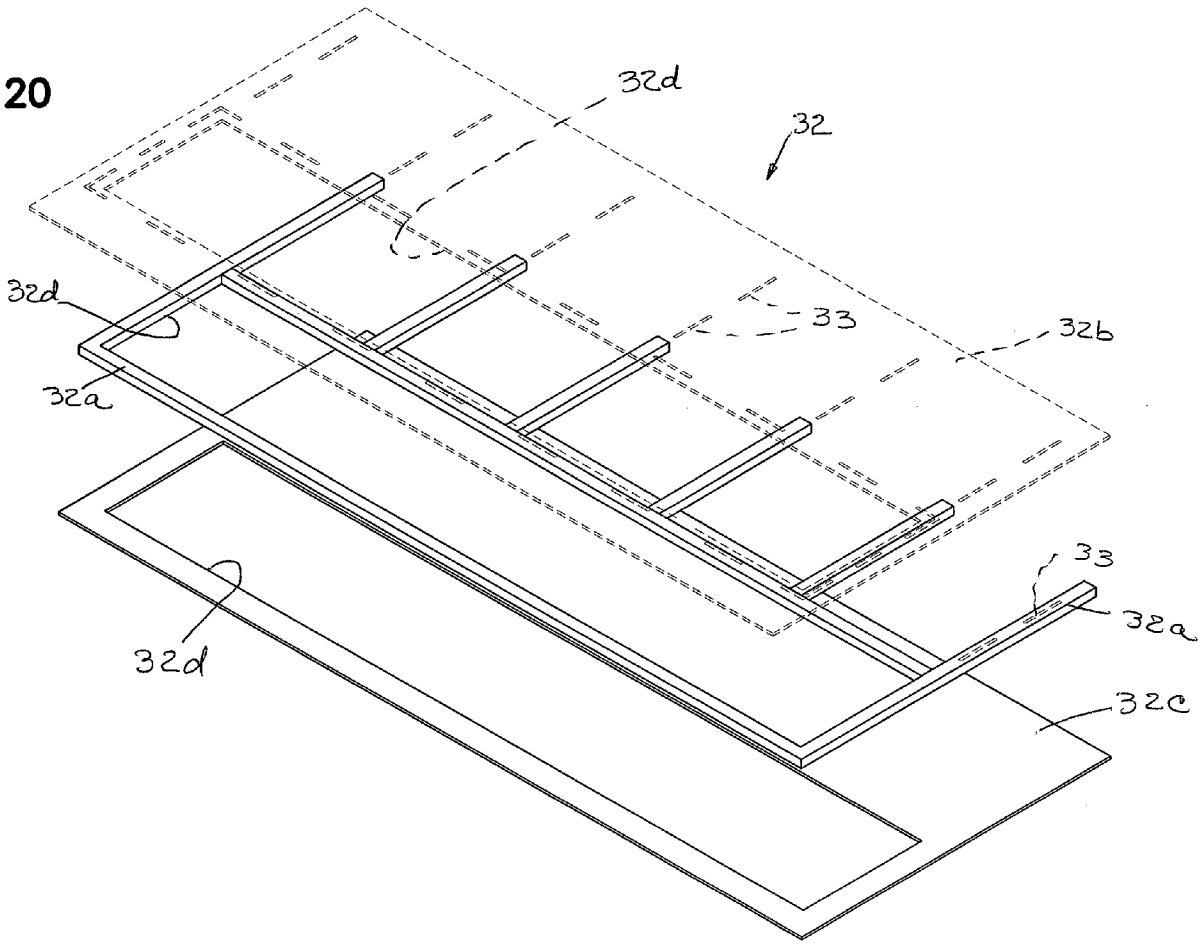
FIG. 20 is an exploded perspective view illustrating the multilayer construction of the bottom wall of the bucket assembly.

While the bottom wall 32 could be of a single sheet construction, for reasons that will become more apparent upon a further description of the bucket assembly, in the preferred embodiment the bottom wall comprises a multi-layer construction as generally illustrated in FIG. 20 for providing additional strength and thickness to the bottom wall for supporting multiple blade members secured thereto (hereinafter described). The bottom wall 32 has a bar spacer frame 32*a* sandwiched between top and bottom plates 32*b*, 32*c* respectively. The top and bottom plates 32*b*, 32*c* are respectively welded to the bar spacer frame 32*a* as generally indicated by the welding line designations 33, to form a solid unitary composite bottom wall construction. In the preferred embodiment illustrated, the thickness of the composite bottom wall structure is approximately one inch; however, it will be understood by those skilled in the art that such dimension, as is the case for all dimensions referred to herein with respect to preferred embodiments of the invention are subject to change as dictated by design, bucket sizes and functional use requirements. The top and bottom plates 32*b*, 32*c* define cooperative rectangular openings, generally designated at 32*d* adjacent the forwardly disposed sides of the bottom wall. The bar spacer frame 32*a* is also configured to form a rectangular opening sized to align with those of the top and bottom plates such that when welded together the inner edges of the composite structure along the opening sides appear generally uniform. That portion of the bar spacer frame 32*a* which lies adjacent the rectangular opening 32*d* provides structural strength to those portions of the bottom wall 32 which lie adjacent to the opening 32*d*.

Figure 1:
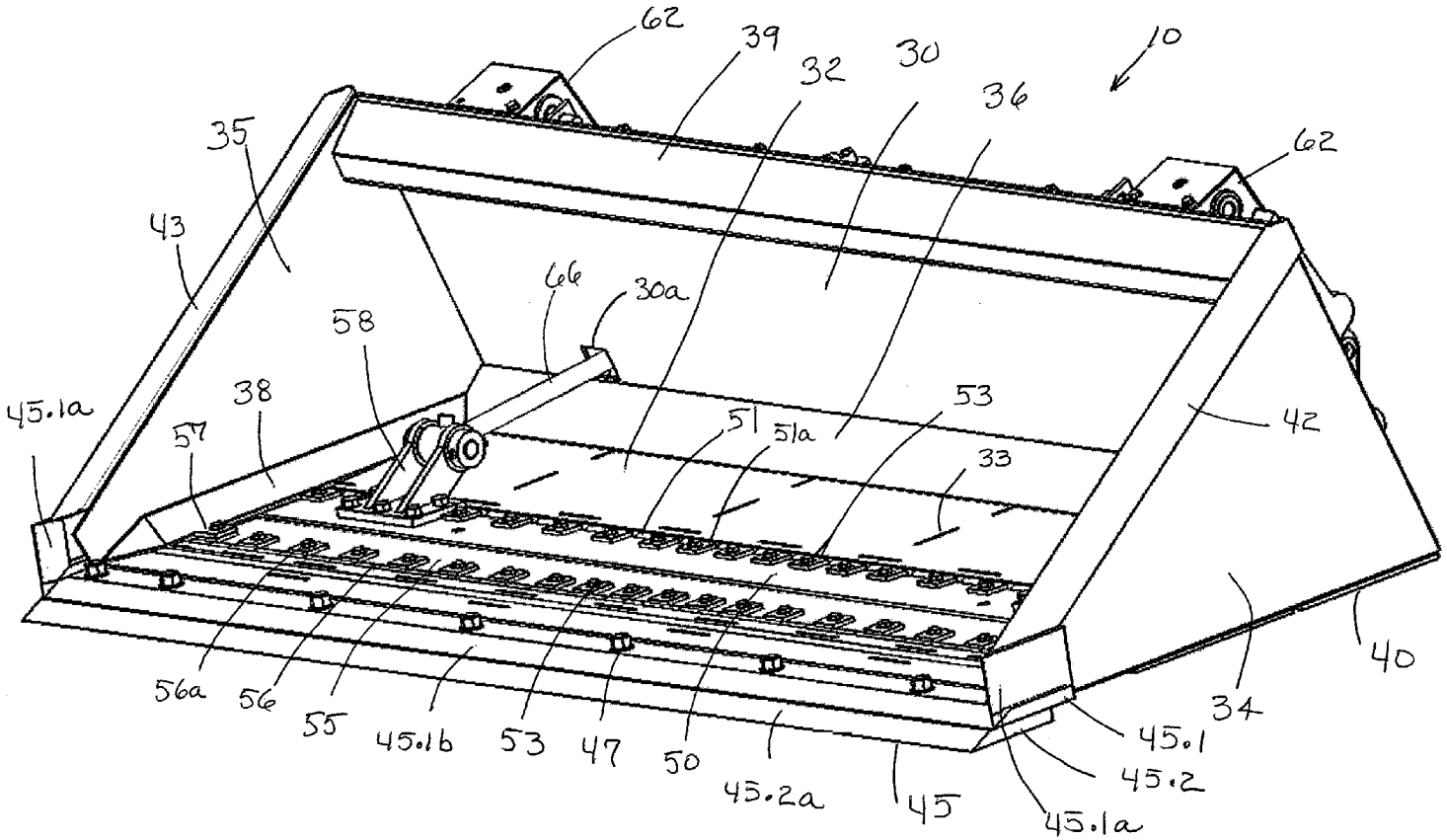
FIG. 1 is a right front top perspective view of a first embodiment of a bucket assembly of the invention, illustrating scraper and grader blade portions thereof in closed positions.

In the preferred construction of the bucket assembly, the rear wall 30, the right and left sidewalls 34, 35 and the lower back, right and left gusset members 36, 37, 38 are generally of the same thickness and are constructed from mild steel. The upper support gusset bar 39 is slightly thicker than the lower gusset members and is also constructed of mild steel. In the preferred embodiment construction, the bar spacer frame 32*a* and the top and bottom plate members 32*b* and 32*c* comprising the bottom wall 32 are constructed of mild steel or preferably of a stronger wear plate material such as AR-400 wear plate material. A rectangular shaped wear plate 40 (FIG. 6) is welded to the lower surface of the rectangular portion of the bottom plate material 32*c* to provide additional wear resistance to the lower side of the bottom wall 32. In the preferred embodiment, the bottom skid wear plate 40 is also constructed of wear plate material such as AR-400 wear plate steel. A pair of upper blade wear surface members are welded to the upper edges of the right and left sidewalls 34, 35 respectively and are illustrated at 42 and 43 respectively (FIG. 1). The upper blade wear surfaces 42, 43 are constructed of hardened blade material such as 1060 blade material and provide both structural strength to the upper edges of the sidewalls 34, 35 as well as protecting the upper edges of the sidewalls from damage during operation and use of the bucket assembly. A primary front blade 45 is mounted to and forms part of the forward edge of the bottom wall 32 of the bucket assembly. The front blade 45 is in the preferred embodiment formed from two blade members. An upper generally U-shaped blade member 45.1 is welded to the forward end of the bottom wall 32. The upper forward blade member 45.1 has a pair of upwardly projecting wear surface members, generally indicated at 45.1*a* that extend up along and are welded to the outer front sidewall surfaces of the right and left sidewalls 34, 35 to provide protective support and strength to the forward edge portions of the sidewalls. The upper portions of the side wear plate members 45.1*a* are welded to the forward ends of the right and left upper blade wear surfaces 42 and 43 to provide a unified wear structure along the entire forward and upper edges of the sidewalls 34, 35. The upper forward blade member 45.1 includes a plurality of laterally spaced holes for receiving a plurality of mounting bolts 47. The forward edge of the upper forward blade member 45.1 is beveled in a downward direction toward the front of the bucket assembly as indicated at 45.1*b*. A lower forward blade member 45.2 is detachably secured to the bottom surface of the upper forward blade member 45.1 by the plurality of bolts 47. The forward edge of the lower blade member 45.2 is beveled as shown at 45.2*a* at an angle that generally matches that of the forward bevel 45.1*b* of the upper blade member 45.1 such that the two beveled surfaces 45.1*b*, 45.2*a* lie generally in the same plane. The front beveled edge 45.2*a* of the lower forward blade member 45.2 forms the front most portion of the bucket assembly. The primary front blade 45 forms the primary blade structure for the bucket assembly 10, when the bucket is used for normal loading and digging operations wherein material enters the bucket through the open forward end thereof. In the preferred embodiment, the upper and lower forward blade members 45.1, 45.2 are each six inches wide and are formed from a hardened blade material such as 1060 blade material and are approximately ¾ inches thick. The fasteners 47 enable the lower forward blade member 45.2 to be readily replaced when worn or damaged through use, or for other maintenance purposes.

Figure 8:
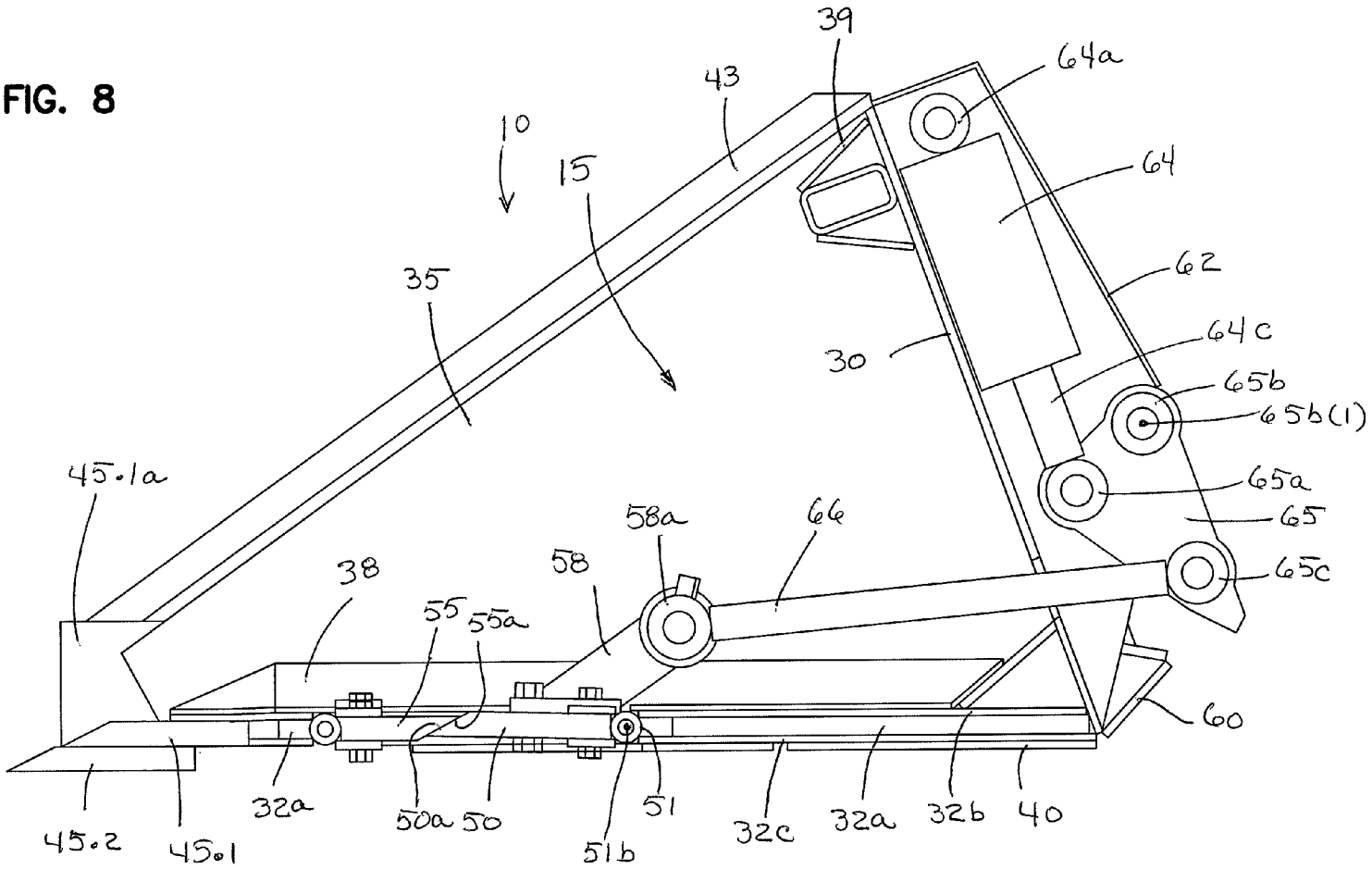
FIG. 8 is a diagrammatic view taken from the right side of the bucket assembly of FIG. 6, taken generally along the Line 8-8 of FIG. 5.

First and second blade members 50, 55 are cooperatively mounted to the forward and rearward facing edges of the bottom wall opening 32*d* to cooperatively close the opening 32*d* when positioned as illustrated in FIGS. 1-5. The first blade member 50 (hereinafter referred as the scraper blade) is mounted by a hinge assembly, generally indicated at 51 to the bottom wall 32 along the rear edge of the opening 32*d* therethrough. The second blade member 55 (hereinafter referred to as the grader blade) is mounted along its longitudinal length by means of a hinge 56 to the bottom wall 32 along the forward edge of the opening 32*d* of the bottom wall 32. In the preferred construction, the hinges 51, 56 are of rugged construction having pivotal portions and hinge pins formed of 4140 heat treated material. The hinges are secured to the scraper and grader blades 50, 55 by means of a plurality of mild steel tab members 51*a*, 56*a* respectively. In the preferred embodiment illustrated, the tab members 51*a*, 56*a* mount the scraper and grader blades 50, 55 to the bottom wall 32 by means of a plurality of mounting bolts, generally indicated at 53. The mounting bolts provide for removability and replacement of the scraper and grader blades 50, 55. However, it will be understood that the hinged tab members 51*a*, 56*a* could be fastened to the blade members by other means, such as by welding. In the preferred embodiment, the body portions of the hinges 51, 56 are welded to the bottom wall 32 along the front and rear peripheral edges of the opening 32*d* in the bottom wall and are not removable from the bucket assembly. Referring to FIG. 8, the forwardly facing front edge of the scraper blade is downwardly tapered toward its distal end facing the front of the bucket assembly. The rearwardly facing edge of the grader blade 55 is tapered toward its distal end facing the rear wall 30 of the bucket assembly. The taper angles 50*a* and 55*a* respectively of the scraper and grader blades cooperatively mate with one another as illustrated in FIG. 8 so as to effectively form a continuous upper surface of the bottom wall 32 for closing the opening 32*d* in the bottom wall. The grader and scraper blades are also formed from hardened blade material such as 1060 blade material. In the preferred embodiment, the grader and scraper blades 50, 55 are ¾ inch thick with the grader blade being 4 inches wide and the scraper blade being six inches wide with a cooperative overlap when positioned as shown in FIG. 8, of 1½ inches.

Figure 3:
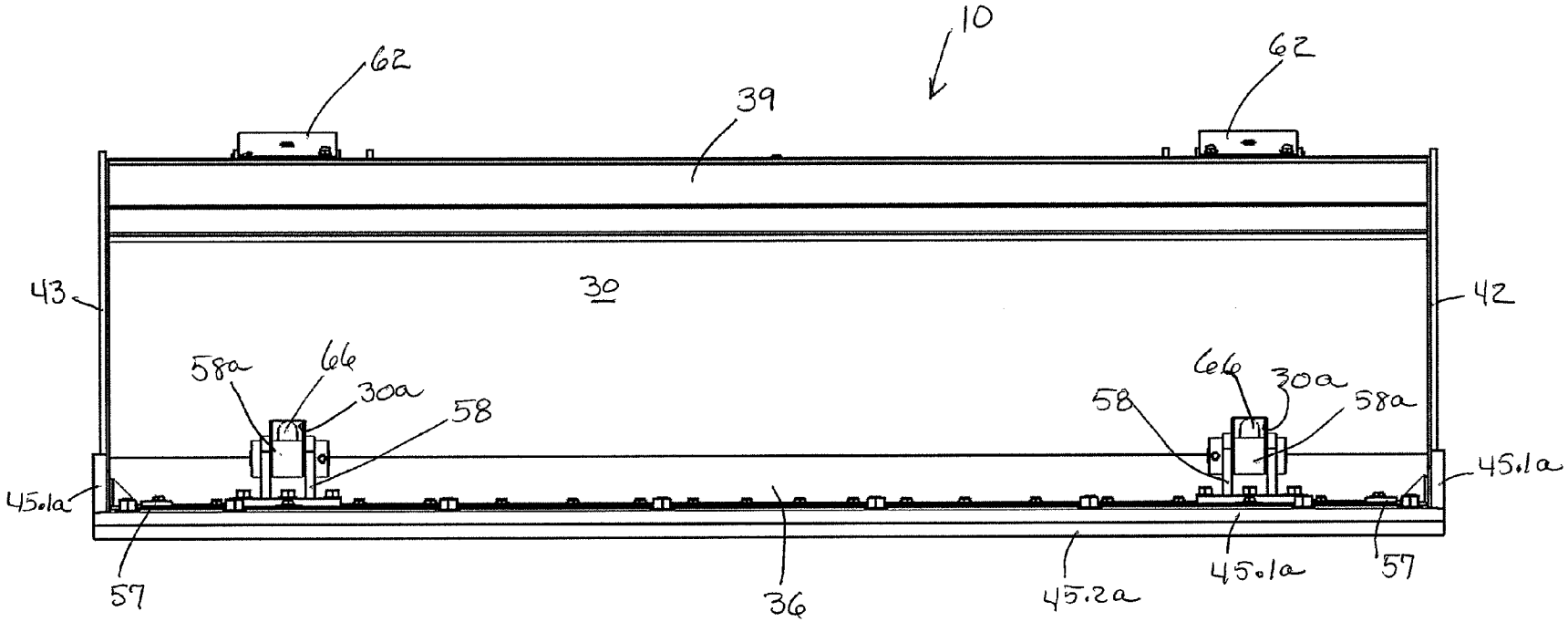
FIG. 3 is a front plan view of the bucket assembly of FIG. 1.

A pair of spaced brackets 58 are secured by bolts to the upper surface of the scraper blade 50. The brackets 58 extend upwardly from the upper surface of the scraper blade 50 and are angled back toward the rear wall generally in longitudinal alignment with the pair of openings 30*a* in the rear wall 30 (FIGS. 1, 3). The brackets 58 each terminate at their respective upper ends in a mounting bushing 58*a* for operatively receiving a boss terminal end of a connecting linkage rod (as hereinafter described).

Figure 2:
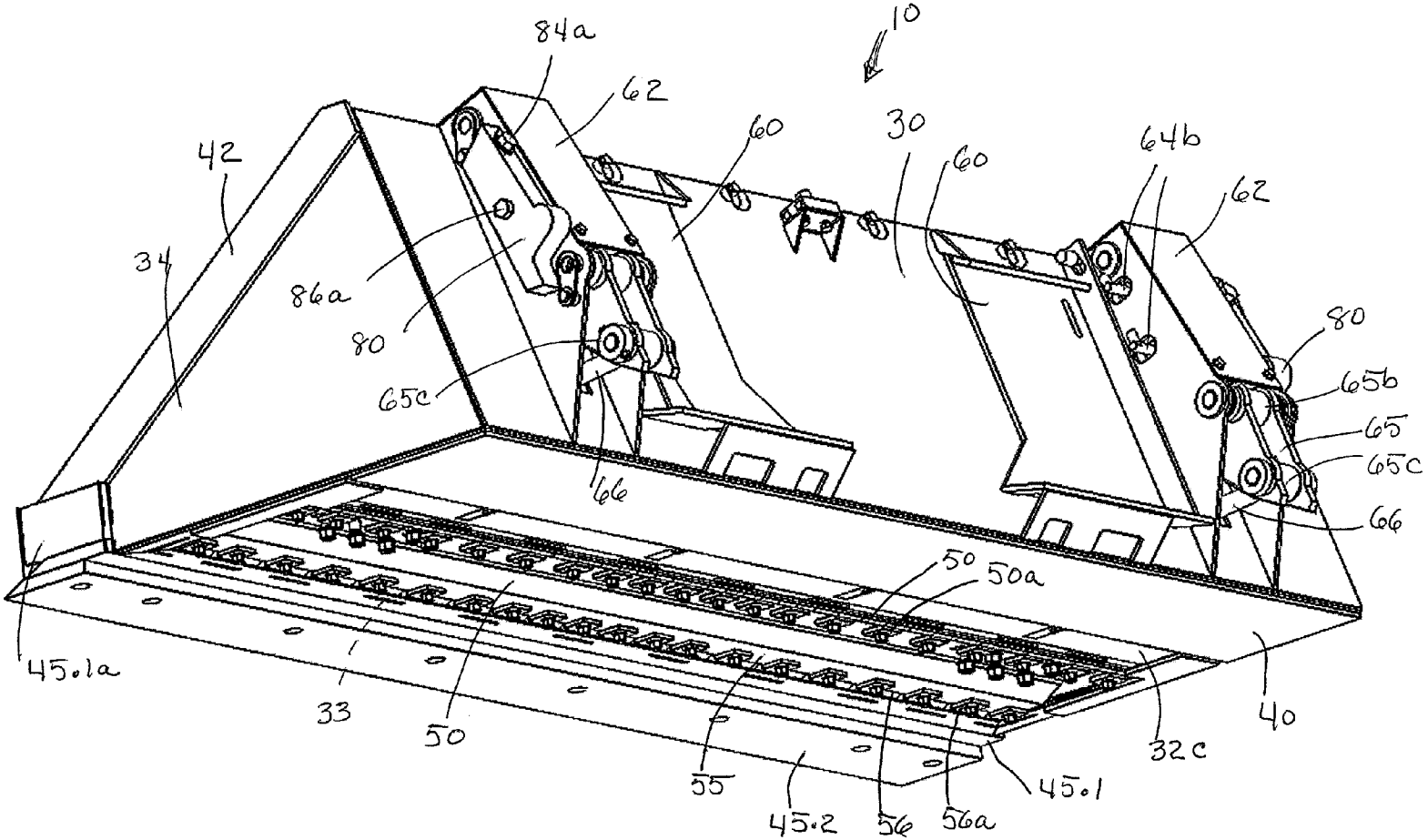
FIG. 2 is a right back bottom view of the bucket assembly of FIG. 1.
Figure 4:
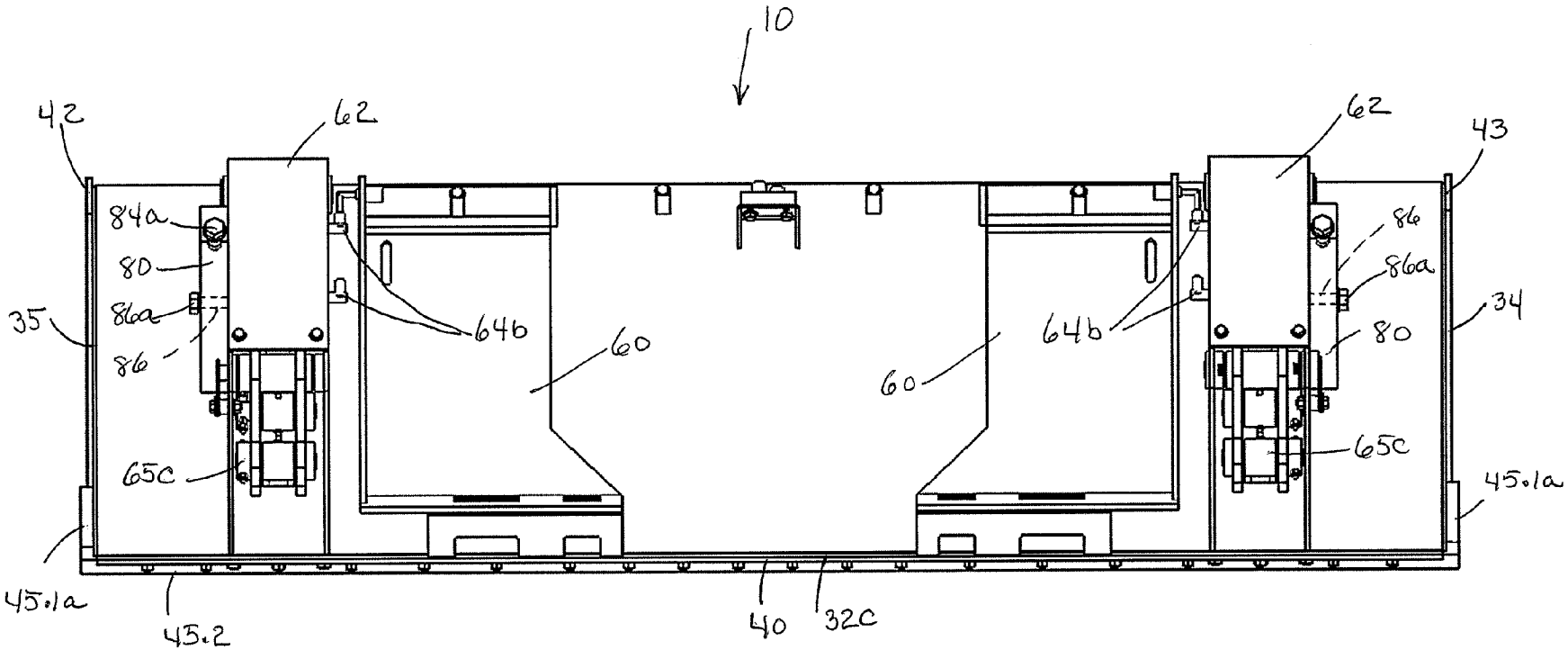
FIG. 4 is a back plan view of the bucket assembly of FIG. 1.
Figure 7:
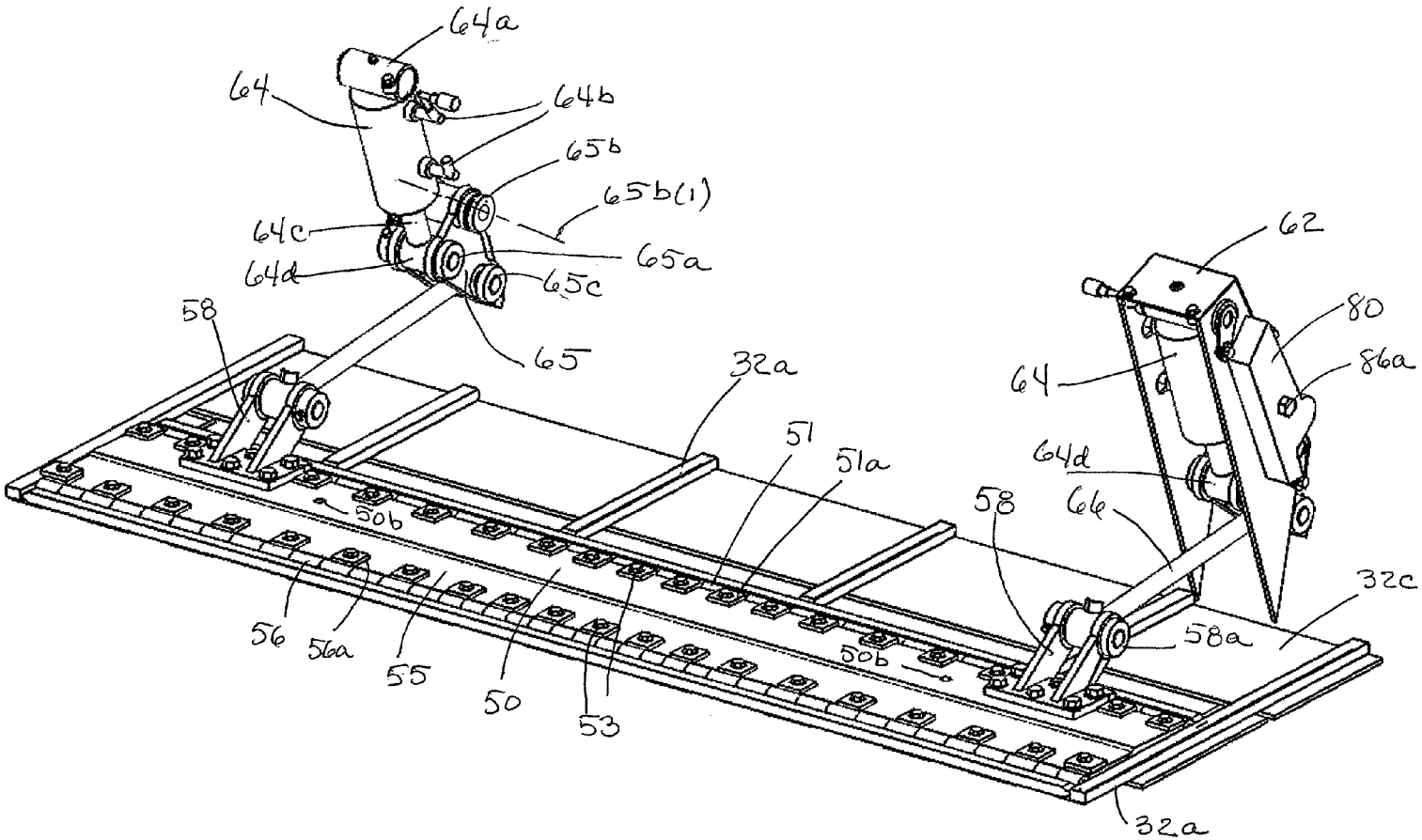
FIG. 7 is a right front top perspective view of a portion of the bucket assembly of FIG. 1 illustrating the scraper and grader blade portions and interconnected linkage and hydraulic operator portions thereof.

The back of the bucket assembly 10 is shown in FIGS. 2 and 4. Referring thereto, a pair of universal mounting hitch brackets 60 are welded in laterally spaced manner to the back surface of the rear wall 30. Such universal mounting hitch configurations are well known in the art and are the type of mounting hitch configurations generally used for attaching implements such as the bucket assembly 10 for operative use to the front hydraulically operated arms 22 of a skid steerer 20 by means of an operative mating portion 61 of the universal hitch assembly (FIG. 10). A pair of hydraulic cylinder mounting brackets 62 are fixedly mounted to the rear wall 30 between the right and left edges thereof and the universal mounting brackets 60. A pair of hydraulic cylinders 64 are mounted, one each, to the two hydraulic cylinder mounting brackets 62, as generally illustrated in FIGS. 7 and 8 and are the power sources for moving the scraper and grader blades 50, 55. FIG. 7 shows the operative control mechanism for the scraper blade 50 in relation to the scraper blade 50 and portions of the bottom wall 32. The mounting brackets 62 substantially protectively cover the hydraulic cylinders 64 mounted thereto. The hydraulic cylinders 64 have a bushing 64*a* at their upper end that mounts the cylinders to their respective mounting brackets 62. Each hydraulic cylinder has a pair of hydraulic fluid inlet and outlet ports, generally illustrated at 64*b*, that are accessible through holes formed in the sidewalls of the brackets 62. No hydraulic lines or controls mechanisms are shown in the drawings for operating the hydraulic cylinders 64. Those skilled in the art will be knowledgeable as to how to connect and control operation of the hydraulic cylinders for proper functioning thereof. Each hydraulic cylinder has a movable piston rod 64*c*, the lower ends of which are respectively connected by means of bushings 64*d* to a first connector 65*a* of a linkage bracket 65.

The linkage brackets 65 are pivotally connected by a second bushing connector generally shown at 65*b* to the sidewalls of the hydraulic cylinder mounting brackets 62. The linkage brackets 65 pivotally rotate about the central axes of their respective second bushing connectors 65*b*. The linkage brackets 65 each has a third bushing connector 65*c*. A pair of linkage rods 66 having first and second boss end portions 66*a* and 66*b* respectively, connect the linkage brackets to the scraper blade brackets 58 through the openings 30*a* formed through the rear wall 30 (FIG. 1). The first boss end 66*a* of each of the linkage rods 66 is pivotally connected to the third bushing connector 65*c* of its respective linkage bracket. The second boss end 66*b* of each linkage rod 66 is pivotally connected to the upper mounting bushing 58*a* of the mounting brackets 58. In the preferred embodiment, the hydraulic cylinders are three inch diameter cylinders with a piston rod stroke of 2.25 inches. The piston rods have a diameter of 1.25 inches. All bushing and boss portions used in the hydraulic cylinder and linkage assemblies previously discussed are of hardened 4140 steel material. Similarly, the linkage rods 66 are constructed of the 4140 heat treated steel and can withstand significant abuse from materials that come in contact with the linkage rods during operation of the bucket assembly.

In the embodiment shown, the above-described linkage assembly operates under control of the hydraulic cylinders 64 and through the rear wall 30 of the bucket and within the collection chamber 15 of the bucket, defined by the rear (30), bottom (32) and side (34, 35) walls of the bucket 10, to rotate the scraper blade 50 about the longitudinal axis 51*b* of the hinge 51, between first (closed) and second (open) positions. When the bucket 10 is to be used as a conventional bucket for loading, transporting, digging, and the like, where only the primary front blade 45 and the upper side blades 42, 43 are used to load material into the bucket in traditional manner, the linkage assembly is operated to rotatably position the scraper blade 50 in its first position as generally shown in FIGS. 1-8. All descriptions of rotational movements of the scraper and grader blades (50, 55) will be as viewed from the right side of the bucket assembly 10 (e.g. like shown in FIG. 8). In its first position, the scraper blade 50 lies generally planar with the bottom wall 32, and its forward beveled portion 50*a* cooperatively retainably engages the front beveled portion 55*a* of the grader blade, preventing the grader blade from rotating in the clockwise (down) direction about its longitudinal axis 56*b* of hinge 56. In such positions, as illustrated in FIG. 8, the engaged scraper (50) and grader (55) blades close the opening 32*d* in the bottom wall 32, allowing the bucket 10 to be operated in traditional manner. In normal use of the bucket 10, the grader blade 55 will not generally rotate upward (in the counterclockwise direction about its hinge axis 56*b*), since the forces imparted by material entering the bucket collection chamber 15 from the front of the bucket, to the upper surface of the grader blade 55, will generally be significantly larger than any lifting forces applied by the underlying ground surface to the bottom surface of the grader blade 55. The following operation descriptions will be made with reference to a single hydraulic cylinder and associated linkage assembly. It will be understood, however, that the description includes the operation of both of the hydraulic cylinders 64 which simultaneously move, and cause simultaneous movement of their associated linkage assemblies, in parallel. When the scraper blade 50 is oriented in its first (closed) position the linkage assembly controlling the scraper blade's position is oriented as generally shown in FIG. 8. The linkage bracket 65 rotates about the central axis 65*b*(1) of its second connector 65*b*. When the hydraulic cylinder 64 is operated to extend its piston rod 64*c*, the piston rod's connection 65*a* to the linkage bracket 65 causes the bracket 65 to rotate in a counterclockwise direction about the axis 65*b*(1) of the second connector 65*b*. Counterclockwise rotation of the linkage bracket 65 causes the third connector 65*c* to rotate in a counterclockwise direction about the axis 65*b*(1), pulling on the linkage rod 66 and its distally connected bracket 58, rotating the bracket 58 and the connected scraper blade 50 in a clockwise direction about the axis 51*b* of the hinge 51.

Figure 9:
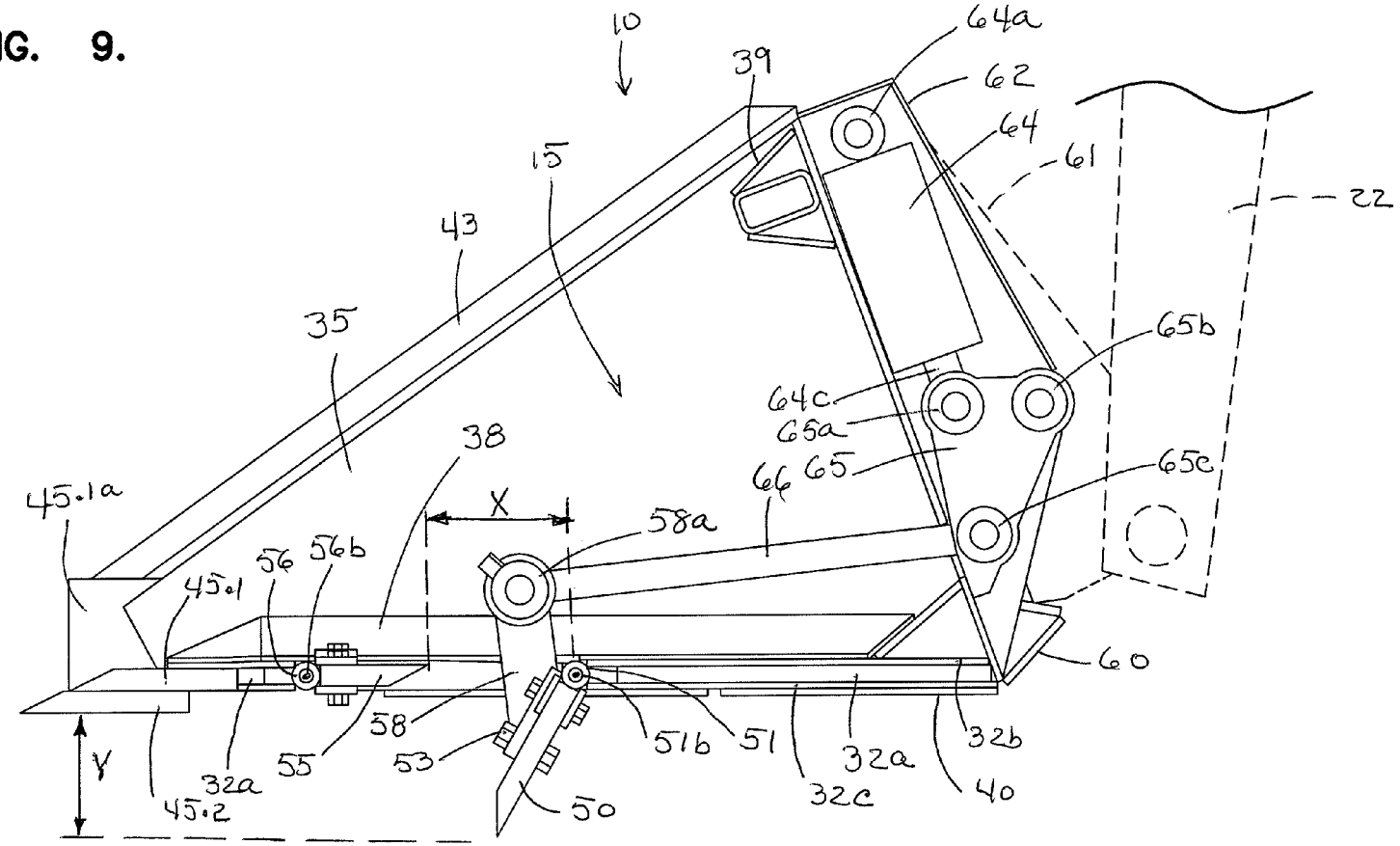
FIG. 9 is a diagrammatic view of the bucket assembly of FIG. 8 illustrating the scraper blade portion thereof in a downwardly pivoted operative position, and showing a portion of a Universal mounting bracket of a motive power source.
Figure 11:
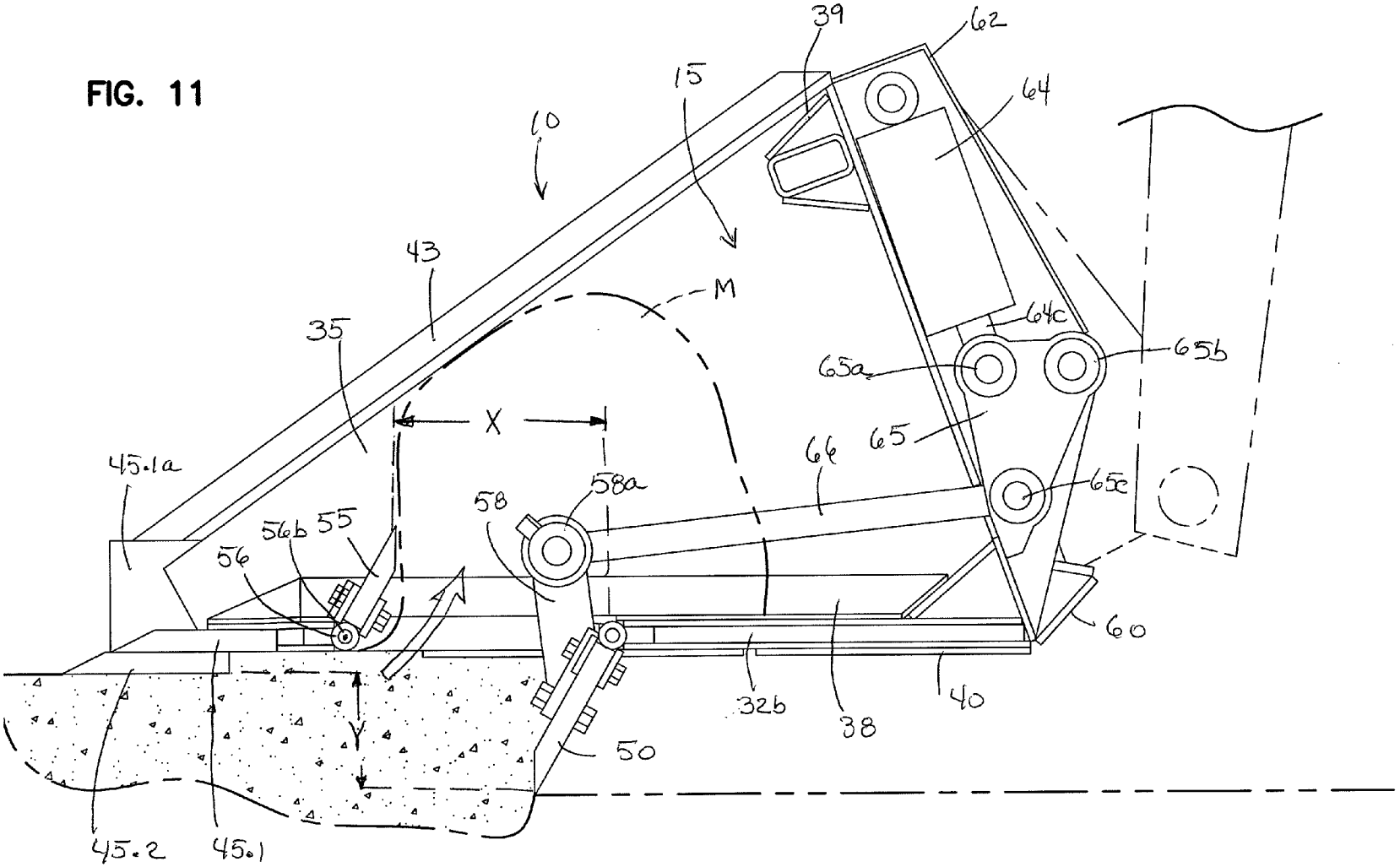
FIG. 11 is an enlarged view of the bucket assembly of FIG. 9 illustrating operational positions of the scraper and grader blade portions thereof when performing a scraping operation.

When it is desired to rotate the scraper blade 50 to a scraping position (see FIGS. 8 and 9), the hydraulic cylinder 64 is operated to retract its piston rod 64*c*, causing the linkage bracket 65 and its third connector 65*c* to rotate in a clockwise direction about the central axis 65*b*(1) of the connector 65*b*, pushing the linkage rod 66 toward the bracket 58. Movement of the linkage rod 66 toward the front of the bucket assembly causes the bracket 58 and its connected scraper blade 50 to rotate in a counterclockwise direction about the hinge axis 51*b*, as illustrated in FIG. 9. Downward rotation of the scraper blade 50 creates an opening through the bottom wall opening 32*d* and into the collection chamber 15 as determined by the extent of rotation of the scraper blade 50 by the linkage assembly. The length of such opening as measured from front to back of the bucket assembly is illustrated in FIG. 9 at "X". As the scraper blade 50 rotates in the counterclockwise (down) direction, its forward blade edge moves downward, away from the general plane of the bottom plate 32*c* of the bottom wall 32. The extent of rotation of the scraper blade 50 in the downward direction defines the "depth" of the scraper cut to be made in the underlying earth or material. The cut depth dimension is illustrated in FIGS. 9 and 11 as "Y", and comprises the vertical distance between the lower surface of the lower forward blade member 45.2 and the lowermost position of the forward tip of the scraper blade 50. When the scraper blade 50 is rotated to its second or "open" position as shown in FIG. 9, the grader blade 55 is left unsupported in the vertical direction. During a scraping operation, and in traditional use of the bucket, a pair of tab stop members 57 rotatably mounted on top of the two laterally outermost tab members 56*a*, laterally extend out beyond the side edges of the opening 32*d* and engage the upper surfaces of the top plate 32*b* of the bottom wall 32 to prevent the grader blade 55 from rotating down (in a clockwise direction) when the scraper blade is moved from its first to second positions. When a grading operation (discussed hereinafter) is anticipated, the stop tabs 57 are rotated 90 degrees to align their edges with the lateral edges of the opening 32*d*, allowing the grader blade 55 to pivot in a downward direction through the opening 32*d*.

To effect a scraping operation, the bucket 10 is lowered to engage the ground or material surface to be scraped such that the lower surface of the primary front blade 45 and the rear wear plate 40 of the bucket engage the ground surface. The bucket orientation is thereafter generally maintained in this orientation throughout the scraping operation. The scraper blade 50 is then lowered by rotation thereof to the desired cut depth (Y) and the motive power source 20 is operated to move the bucket assembly 10 in the forward direction, with the lower surface of the primary front blade 45 skimming across the upper surface of the ground/material to be scraped, and acting as a depth gauge for the scraper blade 50. As the bucket assembly 10 moves in the forward direction, the scraper blade 50 engages and digs into the underlying soil or material as shown in FIG. 11, causing the removed material to be pushed upward against the bottom surface of the bottom wall 32 and the bottom surface of the grader blade 55. Since the primary front blade 45 is only sliding over the ground surface and not performing a digging or scraping operation, little or no material is being introduced into the collection chamber 15 of the bucket through the forward end of the bucket. Accordingly, the differential pressure applied to the lower surface of the grader blade 55 causes the grader blade to rotate in a counterclockwise direction about the central axis 56*b* of the hinge 56, extending the length (X) of the opening 32*d* in the bottom wall and providing material removed by the scraper blade 50 to enter collection chamber 15 through the opening 32*d* of the bottom wall 32 of the bucket. The grader blade 55 provides some direction to the removed material entering the collection chamber 15 and urges the material toward the rear wall 30 of the bucket. The removed material entering the collection chamber 15 is indicated in dashed lines at "M" in FIG. 11. The cut depth (Y) can be changed on-the-fly by an operator by a simple energization of the hydraulic cylinders 64 to rotate the scraper blade in either a raising or lowering direction. When the collection chamber 15 of the bucket 10 has reached its maximum holding capacity, or when the desired scraping operation has been completed, an operator simply activates the hydraulic cylinders 64 so as to cause the attached linkage assembly to rotate the scraper blade 50 back to a closed position for transport of the material within the collection chamber to a desired location.

The grader and scraper blades (55, 50) when mounted as illustrated in FIG. 8 and sized as above-described allow for up to a variable 2 to 1 Y/X ratio ranging from a 0:0 ratio to a 2:1 ratio for dirt entering the bottom of the bucket during a scraping operation as hereinafter described. In other words, if a one inch cut (Y) of material is removed from the ground surface by the scraper blade 50, the forward grader blade 55 will automatically adjust about its pivot point to allow for a 2 inch length of opening (X) into the bottom of the bucket. Similarly, if a 4 inch cut (Y) of material is removed by the scraper blade, the grader blade angle will automatically adjust to approximately an eight inch length of opening (X) for receiving the incoming material. It will be understood that the Y/X ratio can be changed, as for example, by different relative sizing of the scraper and grader blade widths.

Figure 12:
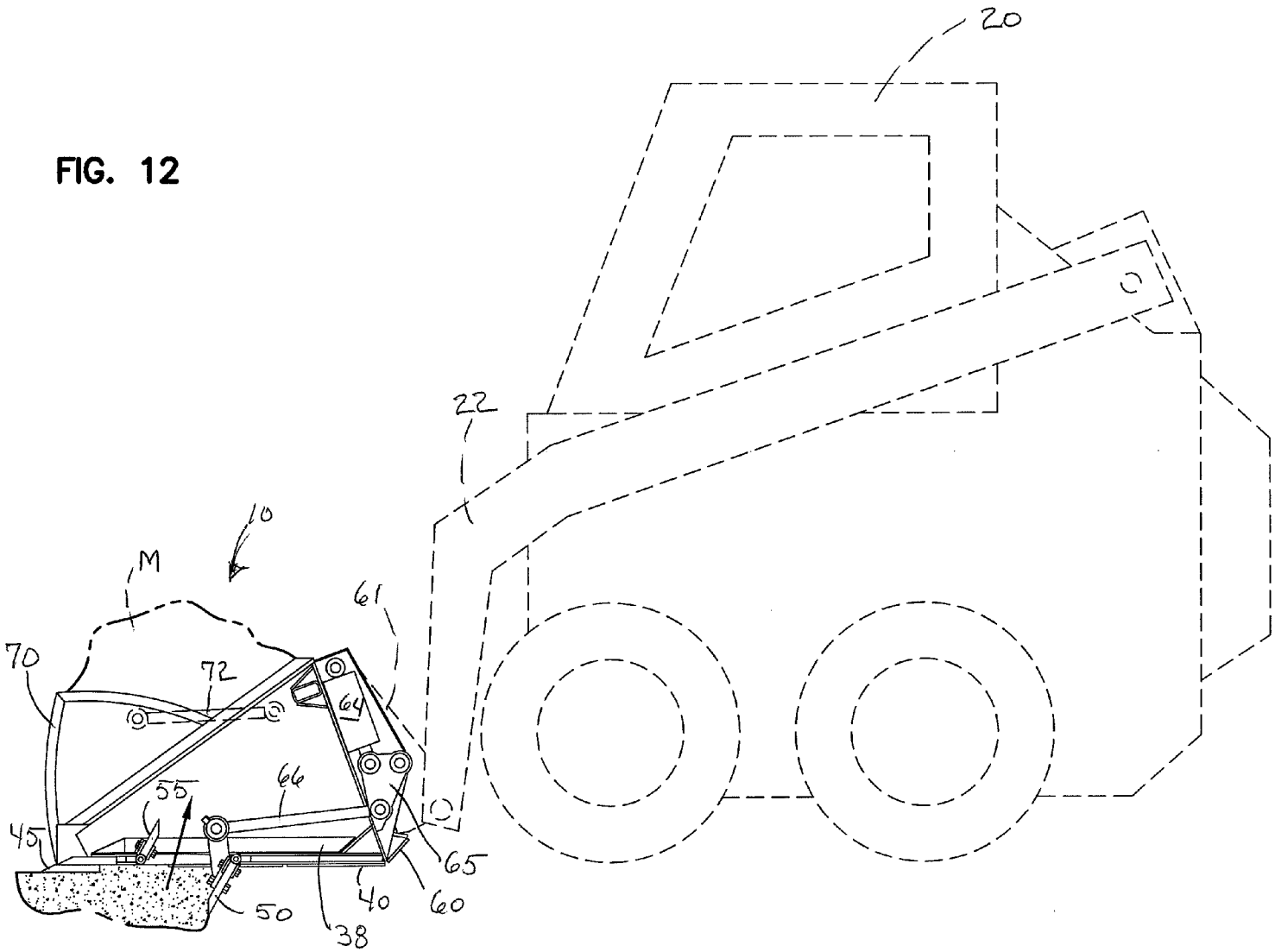
FIG. 12 illustrates the bucket assembly of FIG. 11 operatively connected to a motive power source and showing an additional front gate storage enhancement feature of the bucket assembly.
Figure 13:
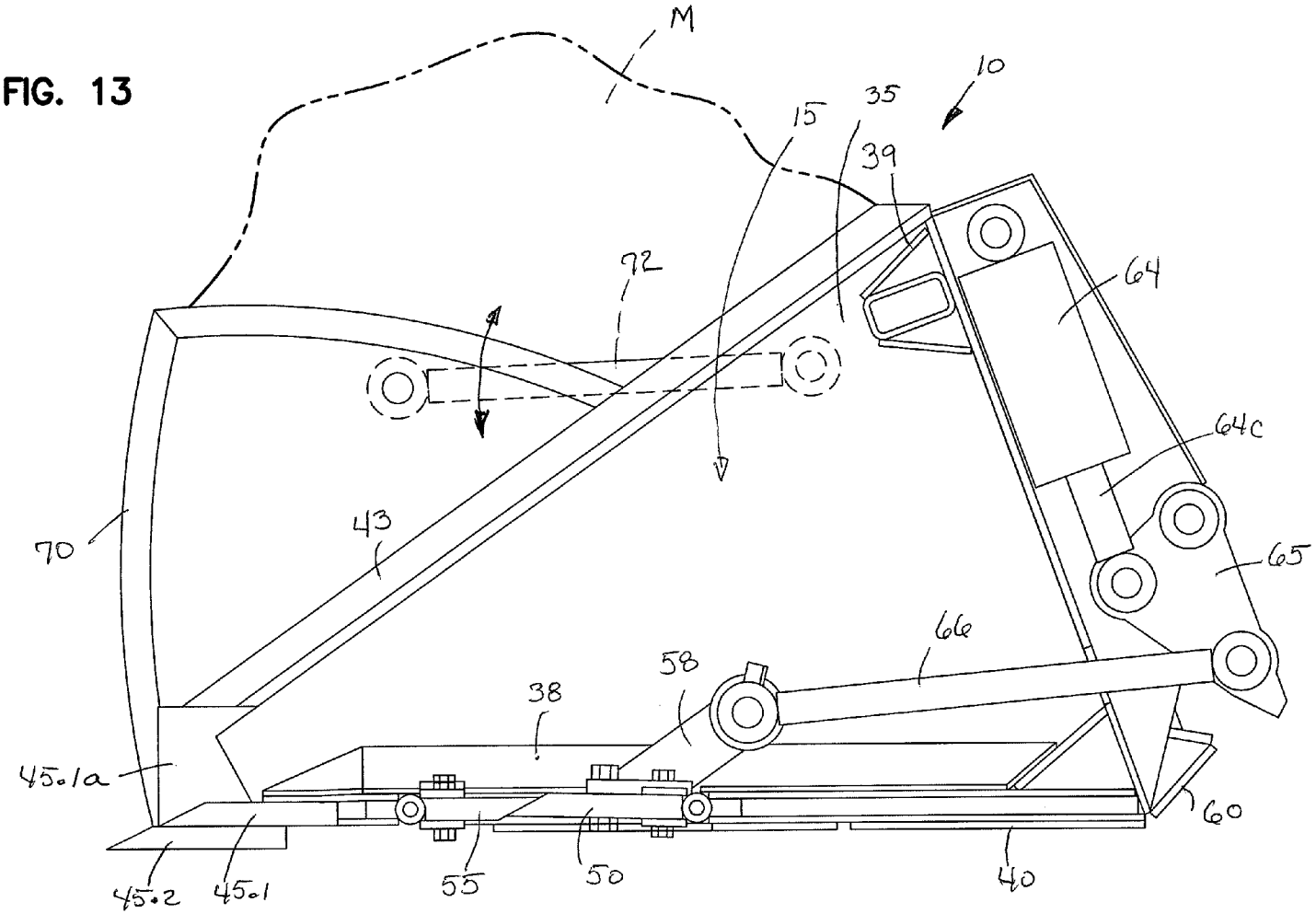
FIG. 13 is an enlarged view of the bucket assembly of FIG. 12 illustrating the scraper and grader blade portions thereof as they would appear in a closed position following completion of a scraping operation.

FIG. 12 shows the bucket assembly 10 operatively positioned in a scraping mode as it might appear being pushed by a motive power source 20 of a skid steerer type. An additional feature, a forward pivotal door assembly 70 has been added to the bucket assembly 10 to increase the volume or load carrying capacity of the collection chamber 15 of the open front loading bucket configuration. An enlarged view of the enhanced bucket assembly of FIG. 12 is illustrated in FIG. 13. FIG. 13 illustrates the scraper and grader blades 50, 55 positioned in a closed position, closing the opening 32*d* in the bottom wall 32 and the forward door assembly 70 positioned in a down position, with a significant amount of removed being held by the enhanced size of the collection chamber of the bucket assembly. A hydraulic mechanism, schematically illustrated at 72 can be configured in any number of ways, as will become apparent to those skilled in the art, for pivotally opening and closing the forward door 70 as desired for loading the collection chamber 15 during the scraping operation or opening the front end of the bucket assembly to enable conventional operation of the bucket assembly when a scraping option is not employed. The forward door assembly can also be configured for rapid detachment from the bucket assembly when scraping operations are not being employed.

Figure 16:
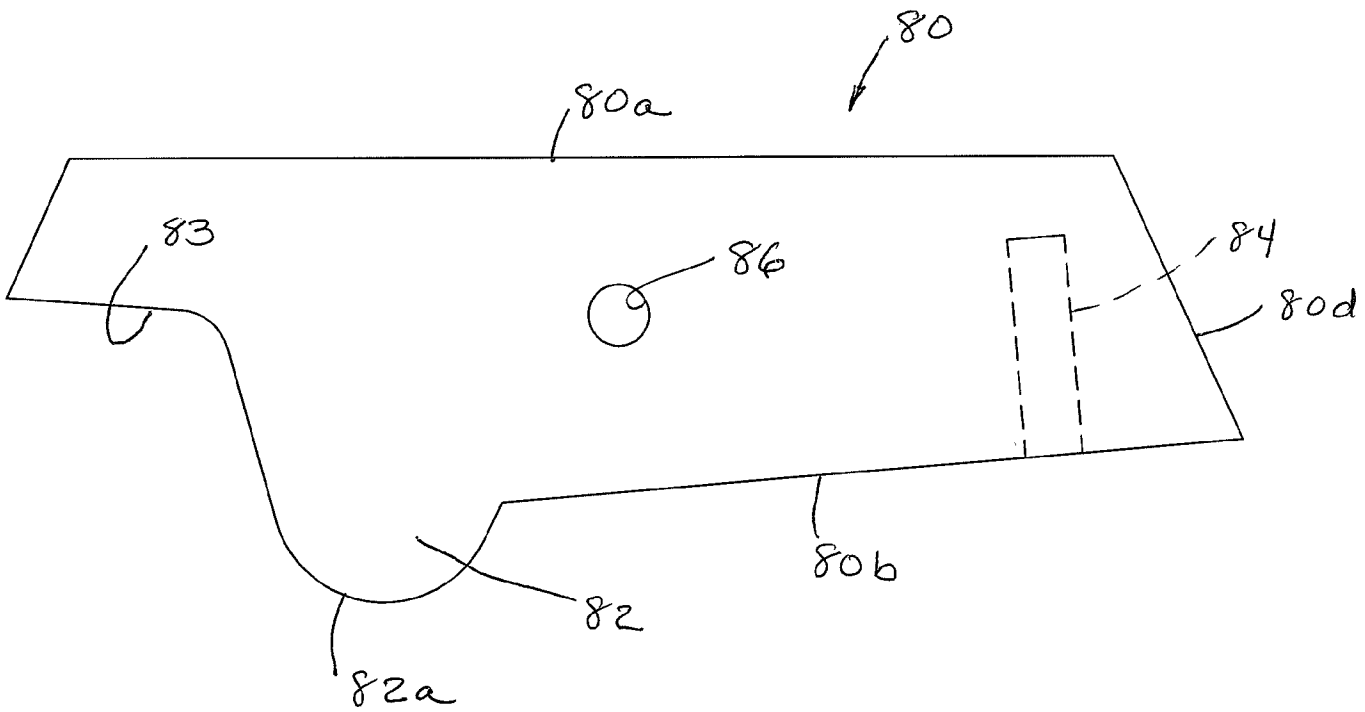
FIG. 16 is a side view of one of the camming block members illustrated in FIG. 14.

The unique cooperative configuration of the first (50) and second (55) auxiliary blades, as above-described, enables use of the same hydraulic/linkage control system for operating the blades 50, 55 in either a scraping or in a grading mode. In the preferred embodiment illustrated, transition of the above-described scraping function to a grading function is achieved by the use of a pair of grader blade cam members, generally indicated at 80. An enlarged side elevation of a grader blade cam member 80 of the preferred embodiment is illustrated in FIG. 16. The cam block member 80 has a generally elongated rectangular or trapezoidal shape, with an upper surface 80*a*, a lower surface 80*b*, a forward end 80*c* and a rear end 80*d*. The lower surface 80*b* defines a downwardly protruding cam portion 82 located toward the forward end 80*c* of the block member, the cam portion 82 defines a curved cam surface 82*a*. The bottom surface of the block member 80 adjacent the forward end 80*c* thereof is generally planar and defines a "stop" surface, generally indicated at 83. The cam surface 82*a* is continuous with the stop surface 83, as illustrated in FIG. 16. A threaded first hole 84 is formed through bottom surface 80*b* of the cam block member 80 and extends from the lower surface thereof, generally at a right angle to the lower surface, and terminates in the block. A second through hole 86 is formed through the cam block 80 and extends between the two sidewalls thereof in a generally perpendicular manner thereto. The through holes 84 and 86 are sized to accommodate mounting bolts (not illustrated in FIG. 16) as hereinafter described.

Figure 5:
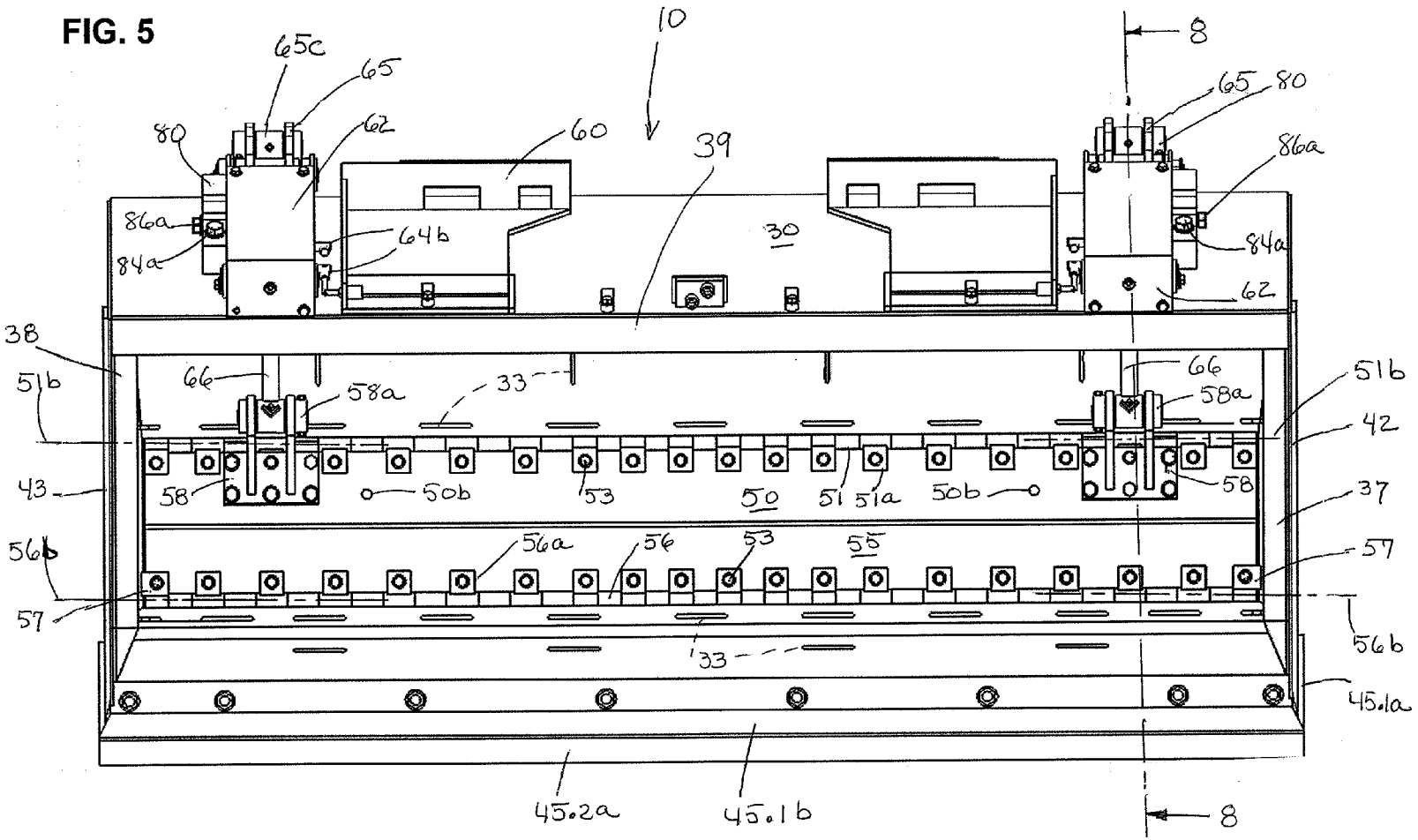
FIG. 5 is a top plan view of the bucket assembly of FIG. 1.
Figure 6:
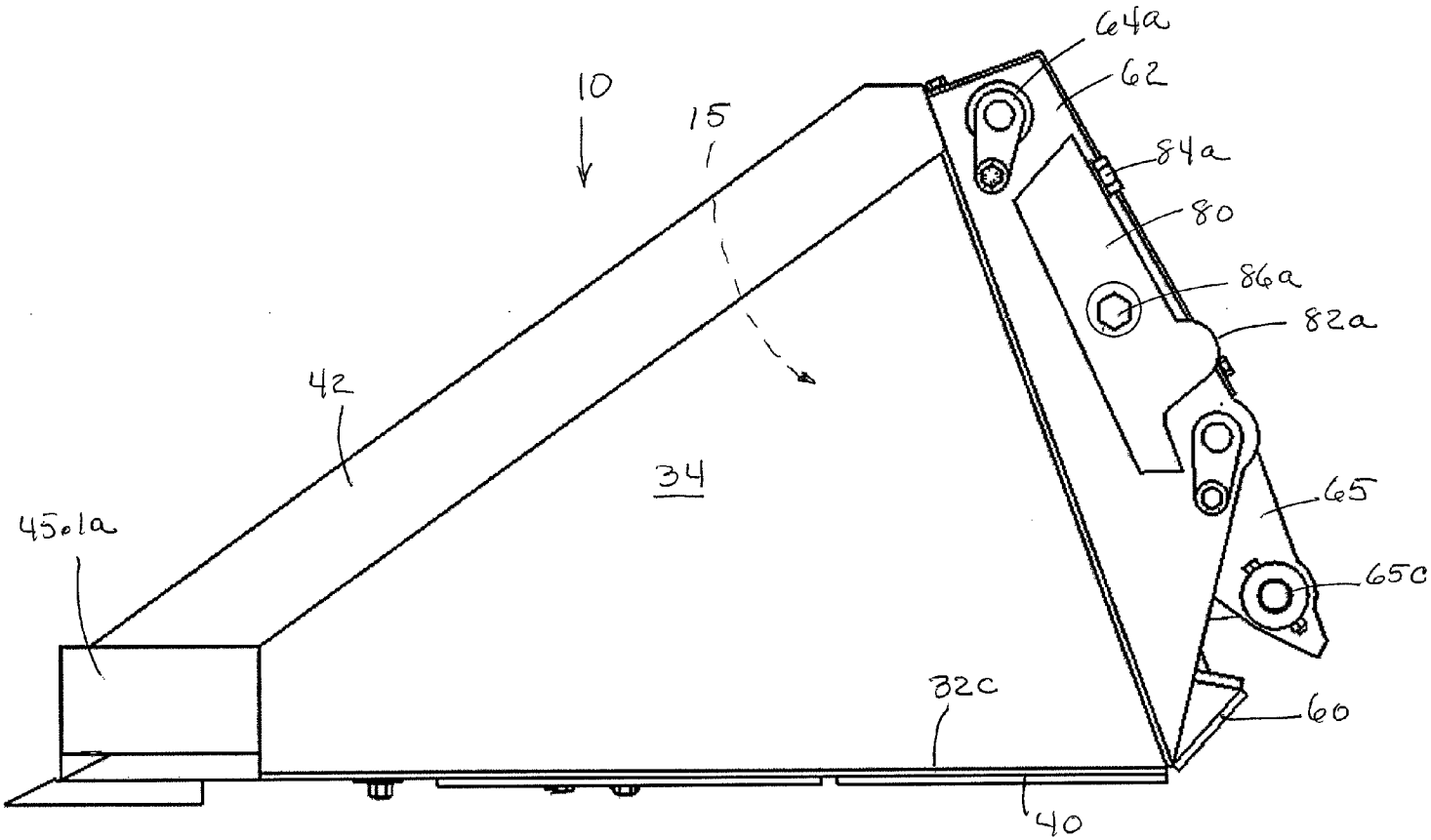
FIG. 6 is a right side plan view of the bucket assembly of FIG. 1, the left side view of the bucket assembly being a mirror image thereof.
Figure 14:
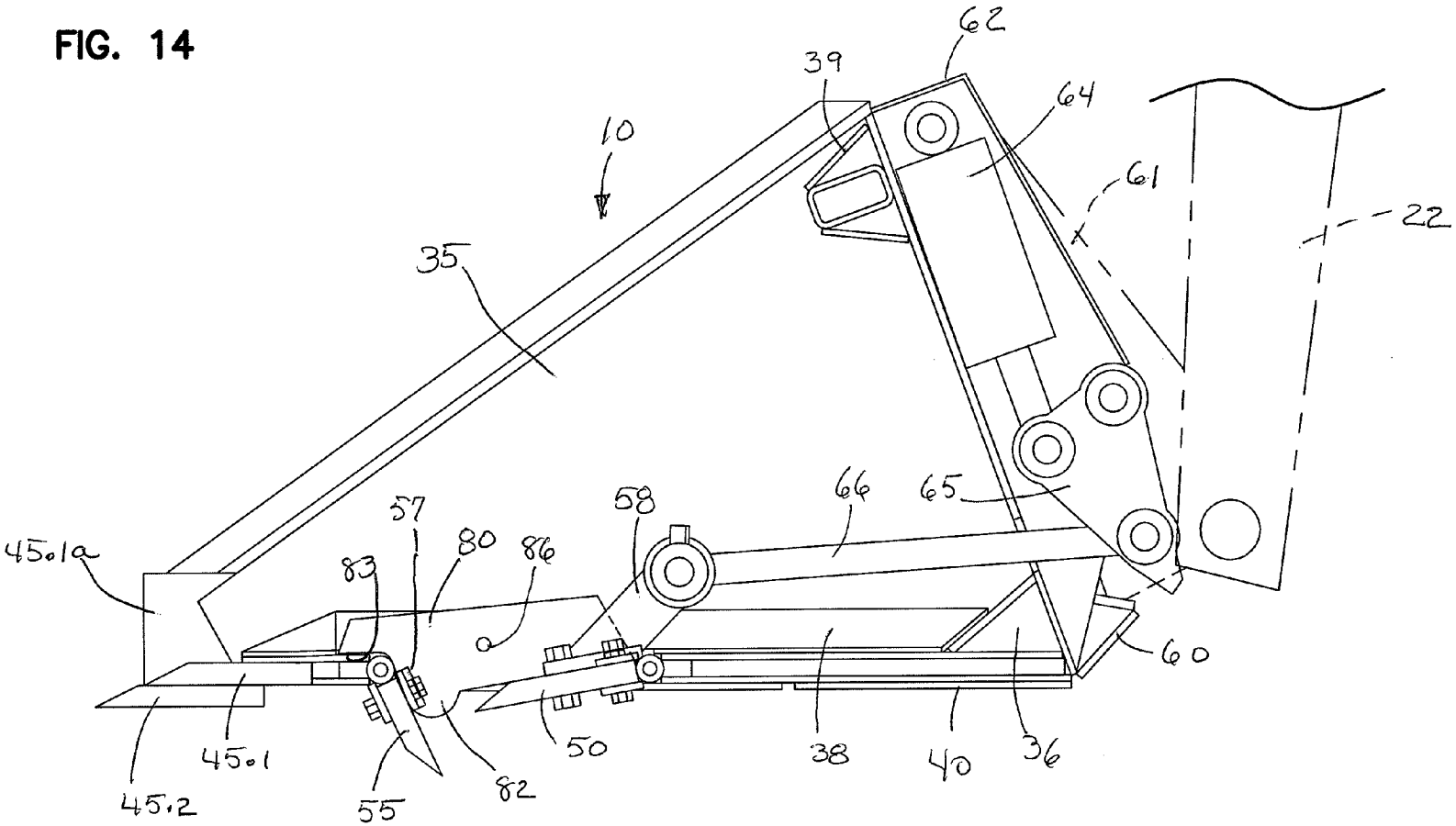
FIG. 14 is a diagrammatic view of the bucket assembly of FIG. 8 illustrating the relative positions of the scraper and grader blade portions thereof as they would operatively appear during a grading operation and illustrating the inclusion of a camming block member between the scraper and grader blades.
Figure 15:
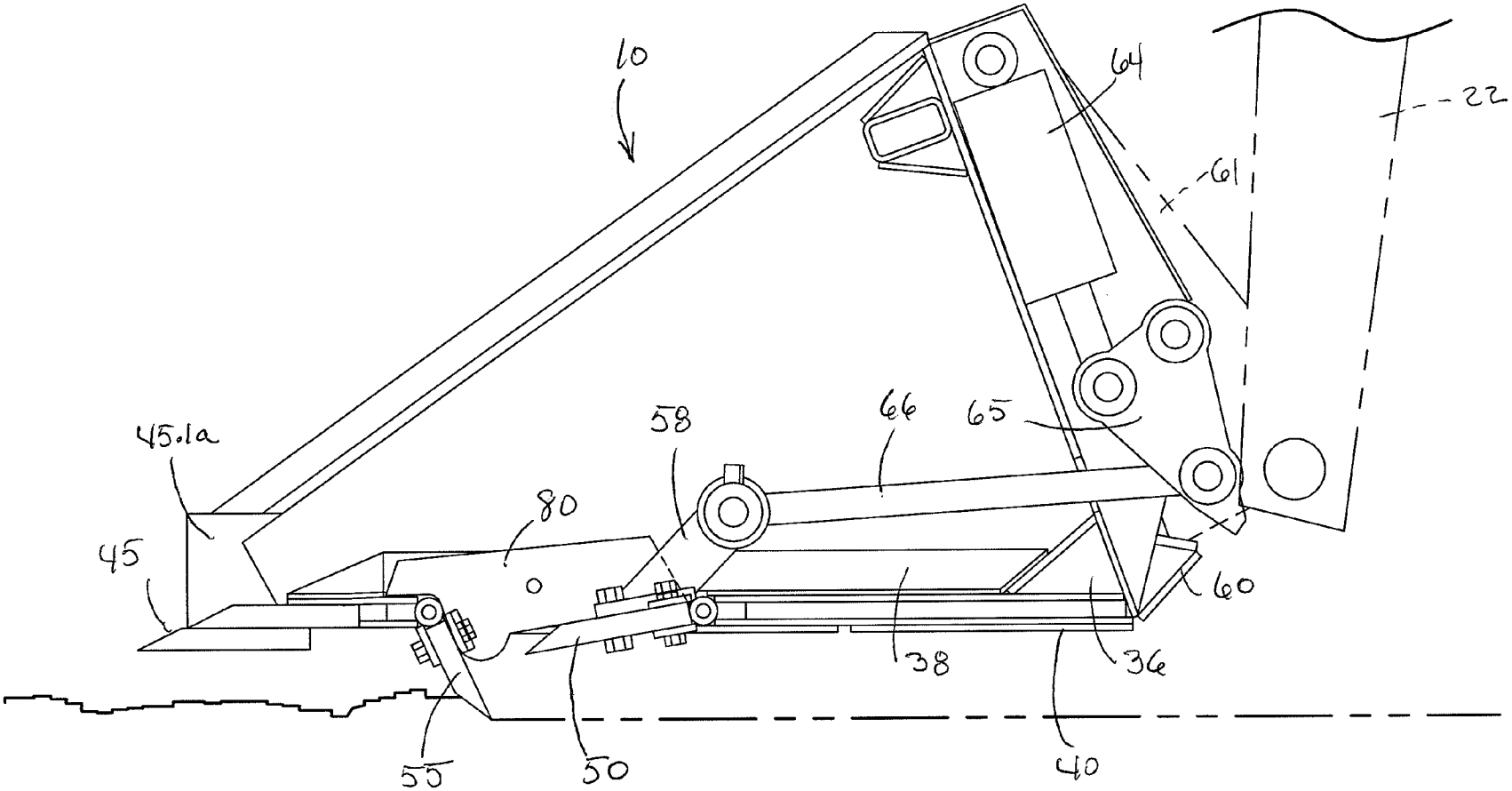
FIG. 15 illustrates the bucket assembly with blade configurations as shown in FIG. 14 as they would appear when performing a grading operation.

When not used for a grading operation, the cam block members 80 are attached in storage positions to the outer sidewalls of the hydraulic cylinder brackets 62 as shown in FIGS. 2, 4, 5, 6 and 7. The cam blocks 80 are detachably mounted to the brackets 62 by means of mounting bolts 86*a* through the hole 86 formed through the sidewalls of the mounting block, and are threaded into threaded side holes/bosses on the outer panels of the cylinder mounting brackets 62. Such mounting provides for ready accessibility to the cam block members and prevents loss or misplacing thereof when they are not being used for a grading mode of operation. Referring to FIG. 5, a pair of laterally spaced mounting holes 50*b* are formed through the scraper blade 50 in the top to bottom direction, generally adjacent to the mounting brackets 58. These holes are used for mounting of the cam block members 80 to the scraper blade 50 for configuring the bucket assembly to a grading mode of operation. When configuring the bucket assembly 10 for operation in a grading mode, the cam block members 80 are removed from attachment by the bolts 86*a* to the hydraulic cylinder mounting brackets 62 and are secured to the scraper blade 50 by means of mounting bolts 84*a* that are inserted through the mounting holes 50*b* in the scraper blade 50 from the bottom surface of the scraper blade and into the threaded holes 84 in the cam blocks. The mounting bolts 86*a* are rethreaded back into the brackets 62 to keep the bracket holes clean and to prevent loss of the bolts 86*a*. Before securing the cam block members to the scraper blade 50 the hydraulic cylinders 64 are energized to position the scraper blade 50 and the grader blade 55 in the closed position, as illustrated in FIG. 8. The cam block members 80 are then secured to the upper surface of the scraper blade as described above such that the cam surfaces 82*a* of the cam blocks 80 engage the upper surface of the grader blade 55. Referring to FIG. 14, the hydraulic cylinders 64 are then activated to rotate the scraper blade 50 in a counterclockwise/downward direction, causing the camming surfaces 82*a* of the cam blocks 80 to slide along the upper surface of the grader blade 55 and apply pressure thereto to rotate the grader blade 55 in a clockwise direction about its axis of rotation. Note that the stop tab members 57 would have previously been rotated by 90 degrees, allowing the grader blade to rotate in a downward direction. Such rotation of the grader blade continues to any desired depth or until the lower stop surface 83 of the cam blocks 80 engage the upper surface of the top plate 32*b* of the bottom wall 32, as illustrated in FIG. 14 which defines the maximum degree of rotation for the grader blade. In the preferred embodiment, the grader blade has a 60 degree range of rotation. The grader blade 55 rotation can be terminated at any point, as desired, during its downward rotation and is then operable for performing a grading operation. The bucket assembly can then be lowered to the desired grading elevation above the ground surface for performing a grading operation as the motive power source 20 moves in a forward direction, as illustrated in FIG. 15. Upon completion of the desired grading operation, the hydraulic cylinders 64 are operated so as to rotate the scraper blade 50 in a clockwise direction about its axis of rotation, raising the scraper blade and its attached camming block members 80 until pressure is removed from the block members such that they can be easily removed from the scraper blade and repositioned in their storage positions on the mounting brackets 62. Once the camming brackets are removed from the scraper blade, the scraper blade can be relowered by activation of the hydraulic cylinders so as to provide clearance for the grader blade to be rotated in a counterclockwise direction back above the forward edge of the scraper blade and enable the scraper and grading blades to cooperatively resume a closed or scraping position. The stop tabs 57 are also moved back to their stop positions as shown in FIG. 5.

Figure 17:
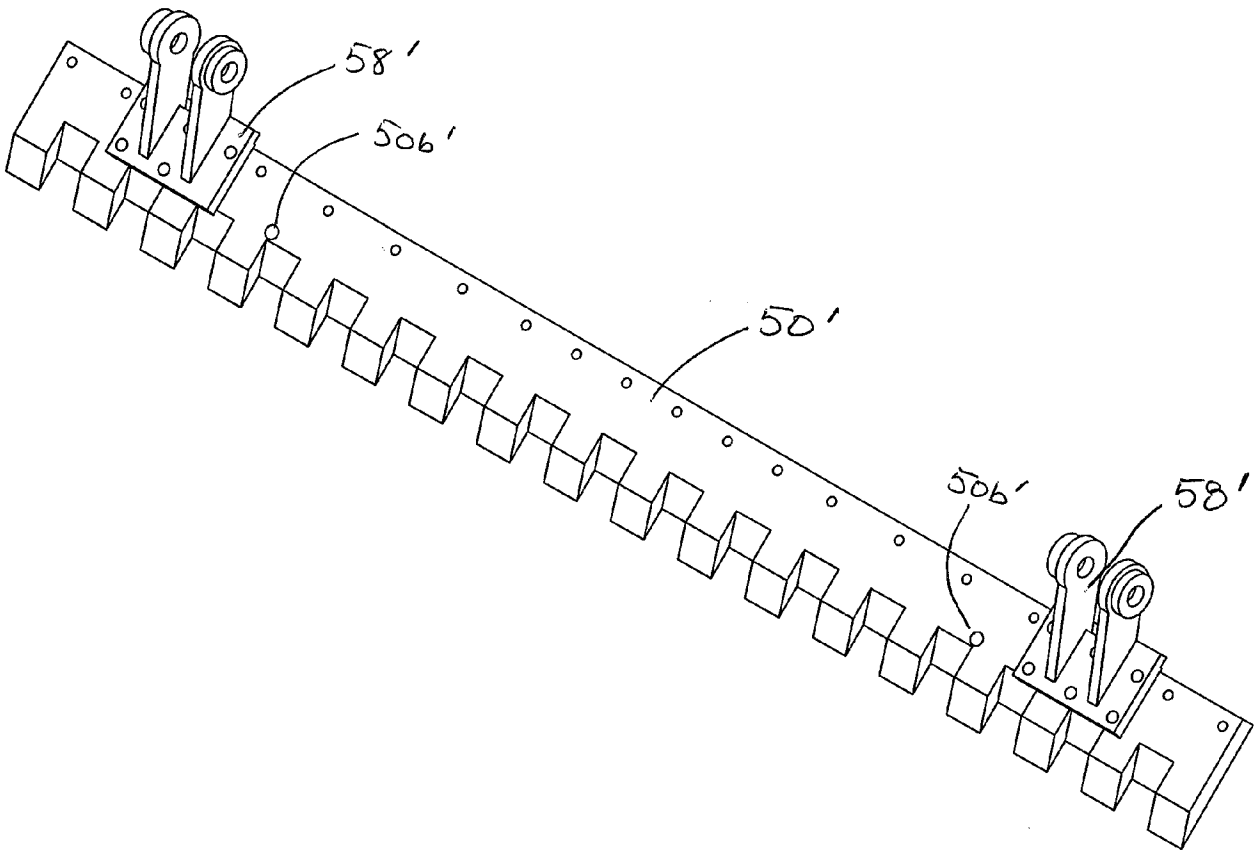
FIG. 17 is a right front top perspective view of a first alternative configuration of the scraper blade portion of the bucket assembly of FIG. 1.

It will be appreciated by those skilled in the art that the configuration of the blade members is not limited to those straight blade configurations illustrated in the previously described preferred embodiment of the invention. For example, the scraper blade could be configured in a toothed manner as illustrated in FIG. 17 at 50' which would facilitate the loosening of hard or packed soil. Similarly, the peripheral shapes of the various blades, and in particular of the scraper blade, is not limited to a rectangular configuration but could be curved or hemispherical is shape such as illustrated in FIGS. 18 and 19 for forming trenching operations preparatory to the laying of pipes or the like, which may be desirable and/or required by law otherwise mandated to form a tight engagement fit with the lower and side surfaces of the pipe being laid.

Figure 18:
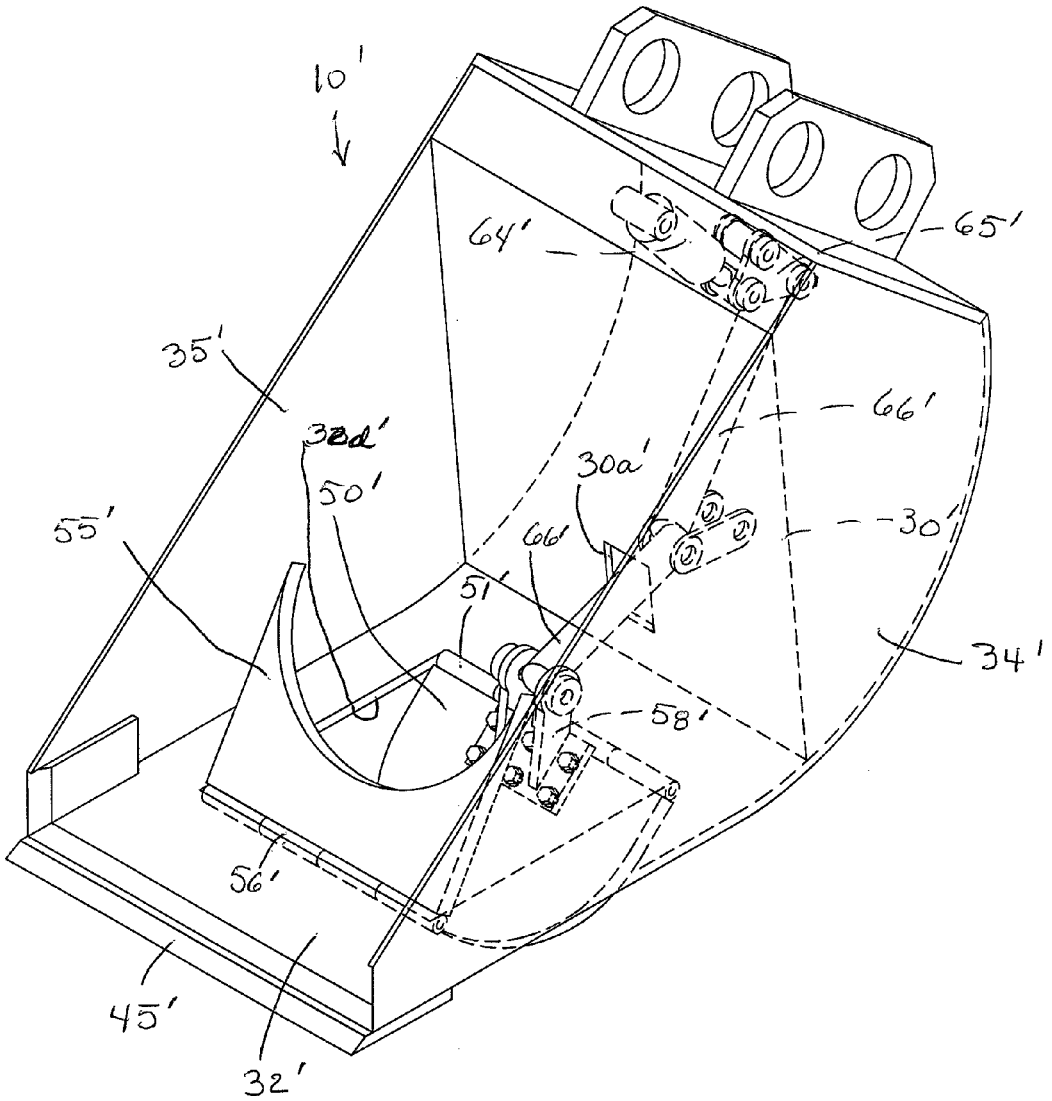
FIG. 18 is a schematic representation of a second embodiment of a bucket assembly of the invention, illustrating a second alternative configuration of a scraper blade illustrated as how it could appear when positioned in a scraping mode during a trenching operation.
Figure 19:
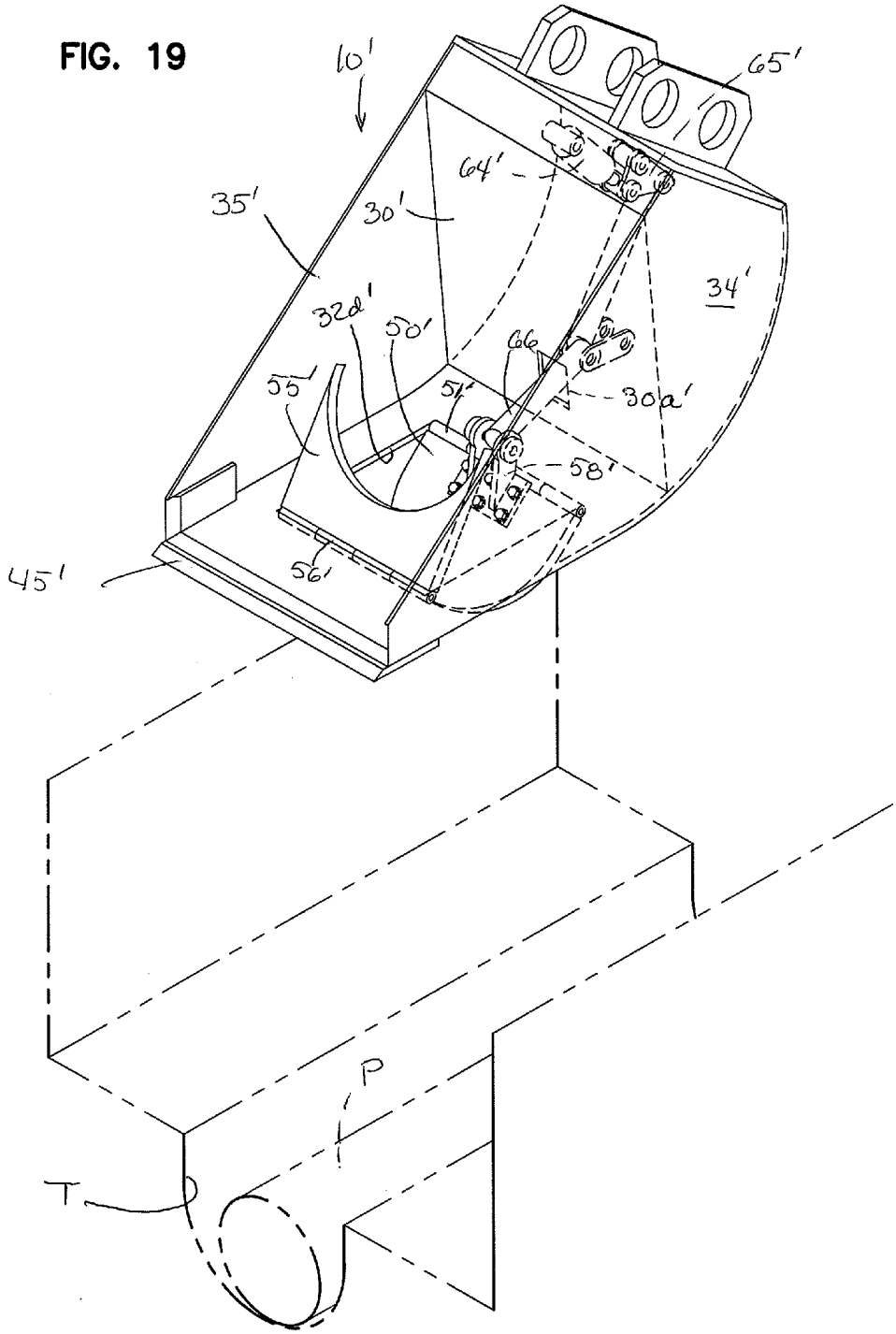
FIG. 19 is a schematic illustration of portion of a trench as it might appear after use of the scraper blade during a trenching operation of the bucket assembly of FIG. 18.

Referring to FIG. 18, the principles of the invention are illustrated as applicable to use with a bucket configuration usable with backhoe types of operations. The particular bucket assembly configuration illustrated is merely intended to be exemplary of how the principles of the invention can be applied to other types of bucket configurations and is not intended to be used or interpreted in any limiting manner. For ease of reference, the same references numerals have been used in FIG. 18 as have been used in describing the prior embodiments of the invention, with the addition of a prime (') designation behind the individual reference numbers.

Referring to FIG. 18, the bucket assembly is generally illustrated at 10' and has rear (30'), bottom (32'), right (34'), and left (35') walls collectively defining an internal collection chamber 15'. The bucket assembly primary front blade member is generally indicated at 45', and the first and second blade members pivotally mounted to the bottom wall 32' are illustrated respectively at 50' and 55'. In the embodiment illustrated in FIG. 18, the scraper blade 50' is configured as a curved blade for forming a curved trench bottom as illustrated in FIG. 19. Accordingly, the second blade 55' which is configured to cooperatively mate with the scraper blade 50' does not form a grading operation in the same sense as was the case in the first described embodiment. However, the general principle of operation of configuring a scraper blade hinged for variable projection through the bottom wall portion of a bucket assembly, and one used for backhoe operations is set forth. While a fairly large protective cover 31 for the hydraulic power and linkage portions has been illustrated, which could actually act as the back wall 30' of the bucket, it will be appreciated that the protective plate portions could be made much smaller, to utilize more of the normal collection chamber size of a conventional backhoe bucket. While the backhoe type of bucket is used by "pulling" the bucket toward the motive power source, as opposed to pushing the bucket as would be the case for front loading operations, the principles of operation of the bucket in both instances are the same with respect to both having a primary forward blade and one or more supplemental blades (such as a scraper blade) spaced back from the primary blade and operating through the bottom wall of the bucket. In the case of a backhoe type of bucket as illustrated in FIGS. 18 and 19, the primary front blade 45' faces the motive power source. Those skilled in the art will recognize the use and significance of applying the principles of this invention to various types of bucket configurations and use applications.

The invention also contemplates provision of a do-it-yourself retrofit kit of parts that would enable one skilled in the art to modify and retrofit a conventionally designed bucket, with parts provided in a kit, that when properly assembled would provide a bucket assembly configured and operative according to the principles of this invention. It is contemplated that such a retrofit kit would include instructions and a template for cutting an opening in the bottom wall of a conventional bucket and to add parts of the kit, such as a scraper blade and associated control and linkage features, thereto. Appropriate mounting brackets for various parts of the bucket assembly could be provided in the kit, which may also include a second grader blade or other type of panel member designed to cooperate with the movable scraper blade for the retrofitted bucket assembly.

As previously stated, the scope of the invention is not to be limited to the use of any specific types of materials that have been recited for use with the described preferred embodiments of the invention, or to the dimensions recited herein for various materials or parts of the preferred embodiments. Further, while specific piano-style types of hinge assemblies extending along the lengths of the scraper and grader blades have been disclosed for mounting the blades to the bucket, the invention is not to be limited to the types of hinge construction described with respect to the preferred embodiments, or to the particular manners in which such hinge structures have been secured to the bucket proper or to the scraper/grader blades. Other forms and placements of structures for pivotally connecting the scraper and/or grader blades to the bucket will be envisioned by those skilled in the art, and are intended to be included within the broad scope of this invention. By way of example only, multiple hinge structures may be used, the blades may be supported at their ends rather than along their longitudinal edges, the blades may be supported by the bucket side or back walls rather than by the bottom walls, etc.

The position of the scraper blade need not be located as far forward along the bottom wall of the bucket as shown in the described preferred embodiments, but could be positioned at other locations between the forward primary blade and the rear wall of the bucket, as long as the scraper blade moveably projects through the bottom wall of the bucket assembly. Further, while it is preferable to have a control and linkage mechanism for the scraper blade that enables the blade to be automatically moved on-the-fly to any desired depth of cut along its length of cut travel, while not requiring an operator to physically move and lock the scraper blade at predetermined discrete cut depth positions, such manual depth control mechanisms for setting the depth of cut of the scraper blade are contemplated within the scope of this invention.

While the preferred embodiments of the invention described herein illustrate simple, efficient and reliable control linkage mechanisms for moving the scraper blade, wherein a portion of the linkage assemblies are positioned within the collector chamber of the bucket so as not to sacrifice the use of significant volume of the collector chamber, the invention is not limited to the use of a linkage mechanism that is positioned within the collector chamber. Those skilled in the art might envision other configurations of control and linkage mechanisms for pivotally moving the scraper blade that do not require such mechanisms to operate within the collection chamber.

As discussed above, while a multilayer bottom wall configuration has been illustrated in the preferred embodiments described, such multilayer wall construction is not required, and the principles of the invention apply to other forms of wall constructions, including those using single layer bottom walls.

While a preferred scraper assembly using a pair of cooperative hinged blade members has been illustrated and described with respect to the described embodiments, it will be understood by those skilled in the art that when configuring a scraper blade application within the scope of this invention, while desirable, a second pivotal panel member or blade in addition to the scraper blade is not required. The second blade could, for example, be replaced by a flat member that operates to selectively enlarge or decrease the length of the opening size for receiving removed material into the collection chamber, in response to changing pressures applied to the bottom of the bucket by the removed material. Alternatively, the second blade or flap member could be eliminated entirely.

In the context of this invention, the concept of using a pair of cooperating blades to selectively apply scraping or grading operations in a bucket assembly has been illustrated and described. In addition, a particular technique using a cam block member and the scraper blade control and linkage mechanism for positioning the grader blade in operative position has been described. It will be understood by those skilled in the art that other techniques and structure can be designed and employed within the spirit and scope of this invention, to move and fix the position(s) of the grader blade for a grading operation.

The above specific descriptions are but example of the multiple design variations that can be envisioned and employed by those skilled in the art, within the broad scope of this invention. All such modifications, variations and alternatives are intended to be included within the broad scope of the appended claims.

What is claimed:

1. A material handling bucket assembly of the type configured to mount to a motive power source and suitable for removal of ground soil in response to movement of the bucket assembly over or into the ground, comprising:

a. a material holding bucket comprising a bottom wall having a front edge, side walls, and a rear wall arranged and configured to define a collection chamber for collecting ground soil engaged and removed from the ground by said front edge;

b. said rear wall being fixedly connected to the bottom and side walls and being oppositely disposed and spaced from said front edge;

c. said bottom wall defining a soil receiving opening therethrough disposed between said front edge and said rear wall;

d. a scraper blade positioned between said side walls and pivotally movable between a first position disposed to substantially close the opening in said bottom wall, and a second position extending from said bottom wall opening outside of said collection chamber in a manner so as to engage, remove and direct ground soil underlying said bottom wall through said opening and into said collection chamber when said bottom wall of said bucket assembly is caused to be moved along the ground surface in a direction toward said front edge, with said front edge engaging and sliding along the ground surface;

e. whereby the ground soil removed by said scraper blade is collected within said collection chamber.

2. A material handling bucket assembly according to claim 1, including a power source mounted to said bucket assembly and operatively connected with said scraper blade to move said scraper blade between said first and said second positions.

3. A material handling bucket assembly according to claim 2, wherein said power source comprises a hydraulic cylinder and a linkage assembly connecting said hydraulic cylinder with said scraper blade.

4. A material handling bucket assembly according to claim 2 wherein said scraper blade has a maximum range of travel position corresponding to a maximum cut depth into the ground surface; and wherein said power source is operable to move said scraper blade to an infinite number of said second positions, between said first position and said maximum range of travel position.

5. A material handling bucket assembly according to claim 3, wherein said hydraulic cylinder is mounted to said rear wall.

6. A material handling bucket assembly according to claim 5, wherein said linkage assembly is connected to said scraper blade through said rear wall.

7. A material handling bucket assembly according to claim 1, wherein said scraper blade is pivotally mounted by means of a hinge to said bottom wall.

8. A material handling bucket assembly according to claim 1, wherein said opening in said bottom wall extends in lateral direction from side to side across substantially the entire width of said bottom surface.

9. A material handling bucket assembly according to claim 1, wherein said bucket assembly is of a front loading type, designed to be loaded by being pushed by a motive power source.

10. A material handling bucket assembly according to claim 1, wherein said bucket assembly is of an excavation backhoe loading type, designed to be filled by being pulled by a motive power source.

11. A material handling bucket assembly according to claim 1, wherein said material handling bucket further comprises a front wall member pivotally connected to said side or rear walls for closing a forward end of said bucket assembly defined by said front edge and said side walls, to increase the material holding capacity of said collection chamber.

12. A material handling bucket assembly according to claim 1, wherein said bottom wall is substantially planar.

13. A material handling bucket assembly according to claim 1, wherein said bottom wall is fixedly secured to said side walls along a majority of a longitudinal depth of said collection chamber as measured from said front edge to said rear wall.

14. A material handling bucket assembly according to claim 1, wherein said bottom wall extends in generally planar manner between said front edge and said rear wall and is fixedly secured to said side walls.

15. A material handling bucket assembly according to claim 1, wherein said scraper blade is pivotable to positions both above and below the general plane of said bottom wall.

16. A material handling bucket assembly of the type configured to mount to a motive power source and suitable for removal of ground soil in response to movement of the bucket assembly over or into the ground, comprising:

a. a material holding bucket comprising a bottom wall having a front edge, side walls, and a rear wall arranged and configured to define a collection chamber for collecting ground soil engaged and removed from the ground by said front edge;

b. said rear wall being fixedly connected to the bottom and side walls and being oppositely disposed and spaced from said front edge;

c. said bottom wall defining a soil receiving opening therethrough disposed between said front edge and said rear wall;

d. a scraper blade pivotally movable between a first position disposed to substantially close the opening in said bottom wall, and a second position extending from said bottom wall opening outside of said collection chamber in a manner so as to engage, remove and direct ground soil underlying said bottom wall through said opening and into said collection chamber when said bottom wall of said bucket assembly is caused to be moved along the ground surface in a direction toward said front edge, with said front edge sliding over the ground surface;

e. a panel member movably mounted adjacent said opening in said bottom wall and cooperative with said scraper blade to regulate the size of said opening during a scraping operation; and f. whereby the ground soil removed by said scraper blade is collected within said collection chamber.

17. A material handling bucket assembly according to claim 16, wherein a forward edge of said scraper blade rotates in a downward direction when moving between said first and said second positions, and wherein at least a portion of said panel member moves in an upward direction to increase said opening size in response to forces subjected to the panel from soil removed by the scraper blade during a scraping operation.

18. A material handling bucket assembly according to claim 16, wherein said panel member is pivotally mounted for movement relative to said opening.

19. A material handling bucket assembly according to claim 16, wherein said scraper blade and said panel member are cooperatively sized and relatively positioned to one another such that during a scraping operation the effective length (X) of the opening created between the scraper blade and the panel member is greater than the depth of cut (Y) of the scraper blade into the ground soil.

20. A material handling bucket assembly according to claim 19, wherein the X/Y ratio ranges up to 2 or more during a scraper operation.

21. A material handling bucket assembly according to claim 18, wherein said scraper blade and said panel member cooperatively engage one another when said scraper blade is in said first position to substantially close said opening in said bottom wall.

22. A material handling bucket assembly according to claim 18, wherein said panel member comprises a second blade member.

23. A material handling bucket assembly according to claim 22, wherein said second blade member comprises a grader blade, wherein said grader blade is pivotal between a first position lying across said opening, to a second position extending from said opening outside of said collection chamber toward the ground surface, in a manner for grading said surface when said bucket assembly is lowered to engage said grader blade with the ground surface and the bucket assembly is caused to be moved in a rear wall to front edge direction.

24. A material handling bucket assembly according to claim 23, further including a camming block member operatively securable for movement with said scraper blade and engageable with said grader blade to move and fix said grader blade in its said second position, in response to movement of said scraper blade.

25. A material handling bucket assembly according to claim 18, wherein said panel member is pivotally mounted by means of a hinge to said bottom wall.

26. A kit for retrofitting a material handling bucket for bottom scraping operations, said bucket being of the type having a bottom wall with a front edge, a pair of opposed side walls connected to said bottom wall along their lower edges, and a rear wall connected to the bottom and side walls and disposed opposite said forward edge, collectively cooperatively defining a collection chamber for holding material such as ground soil; said kit comprising:

a. a template and instructions for removing a portion of the bottom wall to form an elongate opening therethrough;

b. a scraper blade sized and configured to operatively cooperate with said formed elongate opening;

c. a first one or more hinges configured to pivotally attach the scraper blade to the bottom wall, and to position said scraper blade for cooperative pivotal movement relative to said elongate opening, such that said scraper blade is pivotally movable between a first position at least partially closing said elongate opening and a second position wherein its distal blade edge extends below said bottom wall and said opening and projects at an acute angle with said bottom wall in the direction toward said front edge;

d. at least one hydraulic cylinder mounting bracket configured for attachment to said rear wall; and e. a linkage assembly configured for attachment to said cylinder mounting bracket and movable to transmit forces from a hydraulic cylinder operatively mounted to said bracket, to pivotally move said scraper blade.

27. A kit according to claim 26, wherein said panel member is a grader blade, and wherein said one or more hinges for use with said panel member are configured to enable pivotal movement of said grader blade both above and below said bottom wall; and wherein said kit further comprises a camming block attachable to said scraper blade and configured to engage said grader blade to pivotally move and fix said grader blade at a second position below said bottom wall, for use in performing a grading operation.

28. A kit according to claim 26, further comprising:

a. a panel member sized and configured to cooperatively engage said scraper blade adjacent said elongate opening; and b. a second one or more hinges configured to pivotally attach the panel member to the bottom wall for pivotal movement between a first position at least partially covering said elongate opening, to a second position wherein its distal unsecured end pivots upward away from said bottom wall, selectively uncovering said elongate opening.

29. A method of scraping ground soil from a ground surface into a soil collection chamber of a bucket assembly of a type having a fixed bottom wall with a front edge and extending rearwardly and connected to a rear wall and laterally between and connected to opposed side walls, said bottom wall substantially defining a closed bottom of the bucket assembly and collectively defining with said rear and said side walls said soil collection chamber, said bottom wall defining an opening therethrough and spaced back from said front edge, comprising:

a. lowering said bucket assembly to engage said bottom wall with said ground surface;

b. lowering a scraper blade adjacent said opening in said bottom wall by rotating a forward edge of said scraper blade to a position below said bottom wall through said ground surface and into engagement with said soil;

c. advancing said bucket assembly in the direction of said front edge, causing said scraper blade to dislodge said engaged soil; and d. directing said dislodged soil along said scraper blade and through said opening into said collection chamber.

30. The method of claim 29, further comprising: pivoting a panel member adjacent said opening upwardly from the bottom wall during the activating step to variably chance the effective area of said opening in response to the volume of said dislodged soil being directed toward said opening.

* * * * *